US010026388B2

(12) United States Patent
Lu et al.

(10) Patent No.: US 10,026,388 B2
(45) Date of Patent: Jul. 17, 2018

(54) FEEDBACK ADAPTIVE NOISE CANCELLATION (ANC) CONTROLLER AND METHOD HAVING A FEEDBACK RESPONSE PARTIALLY PROVIDED BY A FIXED-RESPONSE FILTER

(71) Applicant: Cirrus Logic International Semiconductor Ltd., Edinburgh (GB)

(72) Inventors: Yang Lu, Cedar Park, TX (US); Ryan A. Hellman, Austin, TX (US); Dayong Zhou, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 0 days.

(21) Appl. No.: 15/241,375

(22) Filed: Aug. 19, 2016

(65) Prior Publication Data

US 2017/0053639 A1 Feb. 23, 2017

Related U.S. Application Data

(60) Provisional application No. 62/207,657, filed on Aug. 20, 2015.

(51) Int. Cl.
*G10K 11/178* (2006.01)

(52) U.S. Cl.
CPC ..... *G10K 11/178* (2013.01); *G10K 11/1784* (2013.01); *G10K 11/1788* (2013.01);
(Continued)

(58) Field of Classification Search
CPC ..... G10K 11/178; G10K 11/1784; G10K 11/1788; G10K 2210/108;
(Continued)

(56) References Cited

U.S. PATENT DOCUMENTS 4,020,567 A 5/1977 Webster
4,352,962 A 10/1982 LaMothe
(Continued)

FOREIGN PATENT DOCUMENTS

CN 101552939 A 10/2009
DE 102011013343 A1 9/2012
(Continued)

OTHER PUBLICATIONS

Wu, et al., "Decoupling feedforward and feedback structures in hybrid active noise control systems for uncorrelated narrowband disturbances", Journal of Sound and Vibration, vol. 350, Aug. 18 , 2015, pp. 1-10, Elsevier.
(Continued)

*Primary Examiner* — Mark Fischer
(74) *Attorney, Agent, or Firm* — Mitch Harris, Atty at Law, LLC; Andrew M. Harris

(57) ABSTRACT

A controller for an adaptive noise canceling (ANC) system simplifies the design of a stable control response by making the ANC gain of the system independent of a secondary path extending from a transducer of the ANC system to a sensor of the ANC system that measures the ambient noise. The controller includes a fixed filter having a predetermined fixed response, and a variable filter coupled together. The variable response filter compensates for variations of a transfer function of a secondary path that includes at least a path from a transducer of the ANC system to a sensor of the ANC system, so that the ANC gain is independent of the variations in the transfer function of the secondary path.

17 Claims, 14 Drawing Sheets

(52) U.S. Cl.
CPC ..... *G10K 2210/108* (2013.01); *G10K 2210/1081* (2013.01); *G10K 2210/3017* (2013.01); *G10K 2210/3026* (2013.01); *G10K 2210/3027* (2013.01); *G10K 2210/3028* (2013.01); *G10K 2210/3055* (2013.01)

(58) Field of Classification Search
CPC ... G10K 2210/1081; G10K 2210/3017; G10K 2210/3026; G10K 2210/3027; G10K 2210/3028; G10K 2210/3055
See application file for complete search history.

(56) References Cited

U.S. PATENT DOCUMENTS 4,649,507 A 3/1987 Inaba et al.
4,926,464 A 5/1990 Schley-May
4,998,241 A 3/1991 Brox et al.
5,018,202 A 5/1991 Takahashi
5,021,753 A 6/1991 Chapman
5,044,373 A 9/1991 Northeved et al.
5,117,401 A 5/1992 Feintuch
5,204,827 A 4/1993 Fujita et al.
5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,377,276 A 12/1994 Terai et al.
5,386,477 A 1/1995 Popovich et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell et al.
5,548,681 A 8/1996 Gleaves et al.
5,550,925 A 8/1996 Hori et al.
5,559,893 A 9/1996 Krokstad et al.
5,563,819 A 10/1996 Nelson
5,586,190 A 12/1996 Trantow et al.
5,633,795 A 5/1997 Popovich
5,640,450 A 6/1997 Watanabe
5,668,747 A 9/1997 Ohashi
5,687,075 A 11/1997 Stothers
5,696,831 A 12/1997 Inanaga et al.
5,699,437 A 12/1997 Finn
5,706,344 A 1/1998 Finn
5,740,256 A 4/1998 Castello Da Costa et al.
5,768,124 A 6/1998 Stothers et al.
5,809,152 A 9/1998 Nakamura et al.
5,815,582 A 9/1998 Claybaugh et al.
5,832,095 A 11/1998 Daniels
5,852,667 A 12/1998 Pan et al.
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,181,801 B1 1/2001 Puthuff et al.
6,185,300 B1 2/2001 Romesburg
6,219,427 B1 4/2001 Kates et al.
6,278,786 B1 8/2001 McIntosh
6,282,176 B1 8/2001 Hemkumar
6,304,179 B1 10/2001 Lolito et al.
6,317,501 B1 11/2001 Matsuo
6,418,228 B1 7/2002 Terai et al.
6,434,246 B1 8/2002 Kates et al.
6,434,247 B1 8/2002 Kates et al.
6,445,799 B1 9/2002 Taenzer et al.
6,522,746 B1 2/2003 Marchok et al.
6,542,436 B1 4/2003 Myllyla
6,606,382 B2 8/2003 Gupta
6,650,701 B1 11/2003 Hsiang et al.
6,683,960 B1 1/2004 Fujii et al.
6,738,482 B1 5/2004 Jaber
6,766,292 B1 7/2004 Chandran
6,768,795 B2 7/2004 Feltstrom et al.
6,792,107 B2 9/2004 Tucker et al.
6,847,721 B2 1/2005 Zhang et al.
6,850,617 B1 2/2005 Weigand
6,917,688 B2 7/2005 Yu et al.
6,940,982 B1 9/2005 Watkins
6,996,241 B2 2/2006 Ray et al.
7,003,093 B2 2/2006 Prabhu et al.
7,016,504 B1 3/2006 Shennib
7,034,614 B2 4/2006 Robinson et al.
7,058,463 B1 6/2006 Ruha et al.
7,092,514 B2 8/2006 Trump et al.
7,103,188 B1 9/2006 Jones
7,110,864 B2 9/2006 Restrepo et al.
7,142,894 B2 11/2006 Ichikawa et al.
7,162,044 B2 1/2007 Woods
7,177,433 B2 2/2007 Sibbald
7,181,030 B2 2/2007 Rasmussen et al.
7,242,778 B2 7/2007 Csermak et al.
7,317,806 B2 1/2008 Harvey et al.
7,321,913 B2 1/2008 McGrath
7,330,739 B2 2/2008 Somayajula
7,340,064 B2 3/2008 Onishi et al.
7,359,520 B2 4/2008 Brennan et al.
7,365,669 B1 4/2008 Melanson
7,368,918 B2 5/2008 Henson et al.
7,406,179 B2 7/2008 Ryan
7,441,173 B2 10/2008 Restrepo et al.
7,466,838 B1 12/2008 Mosely
7,492,889 B2 2/2009 Ebenezer
7,555,081 B2 6/2009 Keele, Jr.
7,643,641 B2 1/2010 Haulick et al.
7,680,456 B2 3/2010 Muhammad et al.
7,742,746 B2 6/2010 Xiang et al.
7,742,790 B2 6/2010 Konchitsky et al.
7,792,312 B2 9/2010 Inoue et al.
7,817,808 B2 10/2010 Konchitsky et al.
7,885,417 B2 2/2011 Christoph
7,885,420 B2 2/2011 Hetherington et al.
7,895,036 B2 2/2011 Hetherington et al.
7,925,307 B2 4/2011 Horowitz et al.
7,953,231 B2 5/2011 Ishida
8,014,519 B2 9/2011 Mohammed et al.
8,019,050 B2 9/2011 Mactavish et al.
8,019,103 B2 9/2011 Kates
8,085,966 B2 12/2011 Amsel
8,098,837 B2 1/2012 Inoue et al.
8,107,637 B2 1/2012 Asada et al.
8,111,835 B2 2/2012 Inoue et al.
8,116,472 B2 2/2012 Mizuno
8,126,161 B2 2/2012 Togami et al.
8,135,140 B2 3/2012 Shridhar et al.
8,144,888 B2 3/2012 Berkhoff et al.
8,155,330 B2 4/2012 Chen
8,155,334 B2 4/2012 Joho et al.
8,165,312 B2 4/2012 Clemow
8,165,313 B2 4/2012 Carreras
8,184,816 B2 5/2012 Ramakrishnan et al.
8,184,822 B2 5/2012 Carreras et al.
8,189,799 B2 5/2012 Shridhar et al.
8,194,880 B2 6/2012 Avendano
8,194,881 B2 6/2012 Haulick et al.
8,194,882 B2 6/2012 Every et al.
8,199,923 B2 6/2012 Christoph
8,218,779 B2 7/2012 Isberg
8,218,782 B2 7/2012 Asada et al.
8,229,106 B2 7/2012 Greiss et al.
8,229,127 B2 7/2012 Jorgensen et al.
8,249,262 B2 8/2012 Chua et al.
8,249,535 B2 8/2012 Ridgers et al.
8,254,589 B2 8/2012 Mitsuhata
8,270,625 B2 9/2012 Sommerfeldt et al.
8,280,065 B2 10/2012 Nadjar et al.
8,285,344 B2 10/2012 Kahn et al.
8,290,177 B2 10/2012 Jeong et al.
8,290,537 B2 10/2012 Lee et al.
8,306,240 B2 11/2012 Pan et al.

(56) References Cited

U.S. PATENT DOCUMENTS

| | | | |
|---|---|---|---|
| 8,311,243 | B2 | 11/2012 | Tucker et al. |
| 8,315,405 | B2 | 11/2012 | Bakalos et al. |
| 8,320,591 | B1 | 11/2012 | Wurtz |
| 8,325,934 | B2 | 12/2012 | Kuo |
| 8,331,604 | B2 | 12/2012 | Saito et al. |
| 8,345,888 | B2 | 1/2013 | Carreras et al. |
| 8,345,890 | B2 | 1/2013 | Avendano et al. |
| 8,355,512 | B2 | 1/2013 | Pan et al. |
| 8,374,358 | B2 | 2/2013 | Buck et al. |
| 8,374,362 | B2 | 2/2013 | Ramakrishnan et al. |
| 8,379,884 | B2 | 2/2013 | Horibe et al. |
| 8,385,559 | B2 | 2/2013 | Theverapperuma et al. |
| 8,385,560 | B2 | 2/2013 | Solbeck et al. |
| 8,401,200 | B2 | 3/2013 | Tiscareno et al. |
| 8,401,204 | B2 | 3/2013 | Odent et al. |
| 8,428,274 | B2 | 4/2013 | Shiraishi et al. |
| 8,442,251 | B2 | 5/2013 | Jensen et al. |
| 8,472,682 | B2 | 6/2013 | Guissin et al. |
| 8,498,589 | B2 | 7/2013 | Husted et al. |
| 8,515,089 | B2 | 8/2013 | Nicholson |
| 8,526,627 | B2 | 9/2013 | Asao et al. |
| 8,526,628 | B1 | 9/2013 | Massie et al. |
| 8,532,310 | B2 | 9/2013 | Gauger, Jr. et al. |
| 8,539,012 | B2 | 9/2013 | Clark |
| 8,548,176 | B2 | 10/2013 | Bright |
| 8,554,556 | B2 | 10/2013 | Yu |
| 8,559,648 | B2 | 10/2013 | Christoph |
| 8,559,661 | B2 | 10/2013 | Tanghe |
| 8,600,085 | B2 | 12/2013 | Chen et al. |
| 8,644,521 | B2 | 2/2014 | Christoph et al. |
| 8,681,999 | B2 | 3/2014 | Theverapperuma et al. |
| 8,682,250 | B2 | 3/2014 | Magrath et al. |
| 8,693,699 | B2 | 4/2014 | Fellers et al. |
| 8,693,700 | B2 | 4/2014 | Bakalos et al. |
| 8,693,701 | B2 | 4/2014 | Scarlett et al. |
| 8,706,482 | B2 | 4/2014 | Konchitsky |
| 8,718,291 | B2 | 5/2014 | Alves et al. |
| 8,737,633 | B2 | 5/2014 | Sibbald et al. |
| 8,737,636 | B2 | 5/2014 | Park et al. |
| 8,744,100 | B2 | 6/2014 | Kojima |
| 8,744,844 | B2 | 6/2014 | Klein |
| 8,750,531 | B2 | 6/2014 | Delano et al. |
| 8,774,952 | B2 | 7/2014 | Kim et al. |
| 8,775,172 | B2 | 7/2014 | Konchitsky et al. |
| 8,804,974 | B1 | 8/2014 | Melanson |
| 8,842,848 | B2 | 9/2014 | Donaldson et al. |
| 8,848,936 | B2 | 9/2014 | Kwatra et al. |
| 8,855,330 | B2 | 10/2014 | Taenzer |
| 8,903,101 | B2 | 12/2014 | Christoph et al. |
| 8,907,829 | B1 | 12/2014 | Naderi |
| 8,908,877 | B2 | 12/2014 | Abdollahzadeh Milani et al. |
| 8,909,524 | B2 | 12/2014 | Stoltz et al. |
| 8,942,387 | B2 | 1/2015 | Elko et al. |
| 8,942,976 | B2 | 1/2015 | Li et al. |
| 8,948,407 | B2 | 2/2015 | Alderson et al. |
| 8,948,410 | B2 | 2/2015 | Van Leest |
| 8,953,813 | B2 | 2/2015 | Loeda |
| 8,958,571 | B2 | 2/2015 | Kwatra et al. |
| 8,977,545 | B2 | 3/2015 | Zeng et al. |
| 9,014,387 | B2 | 4/2015 | Hendrix et al. |
| 9,020,065 | B2 | 4/2015 | Wyville |
| 9,020,158 | B2 | 4/2015 | Wertz et al. |
| 9,020,160 | B2 | 4/2015 | Gauger, Jr. |
| 9,031,251 | B2 | 5/2015 | Alcock |
| 9,037,458 | B2 | 5/2015 | Park et al. |
| 9,053,697 | B2 | 6/2015 | Park et al. |
| 9,055,367 | B2 | 6/2015 | Li et al. |
| 9,058,801 | B2 | 6/2015 | Po et al. |
| 9,066,176 | B2 | 6/2015 | Hendrix et al. |
| 9,071,724 | B2 | 6/2015 | Do et al. |
| 9,076,427 | B2 | 7/2015 | Alderson et al. |
| 9,076,431 | B2 | 7/2015 | Kamath et al. |
| 9,082,387 | B2 | 7/2015 | Hendrix et al. |
| 9,082,391 | B2 | 7/2015 | Yermeche et al. |
| 9,094,744 | B1 | 7/2015 | Lu et al. |
| 9,106,989 | B2 | 8/2015 | Li et al. |
| 9,107,010 | B2 | 8/2015 | Abdollahzadeh Milani et al. |
| 9,113,243 | B2 | 8/2015 | Nielsen et al. |
| 9,123,321 | B2 | 9/2015 | Alderson et al. |
| 9,123,325 | B2 | 9/2015 | Iseki et al. |
| 9,129,586 | B2 | 9/2015 | Bajic et al. |
| 9,131,294 | B2 | 9/2015 | Bright |
| 9,135,907 | B2 | 9/2015 | Fellers et al. |
| 9,142,205 | B2 | 9/2015 | Alderson et al. |
| 9,142,207 | B2 | 9/2015 | Hendrix et al. |
| 9,142,221 | B2 | 9/2015 | Sun et al. |
| 9,153,226 | B2 | 10/2015 | Wurm |
| 9,202,455 | B2 | 12/2015 | Park et al. |
| 9,202,456 | B2 | 12/2015 | Lee et al. |
| 9,203,366 | B2 | 12/2015 | Eastty |
| 9,204,232 | B2 | 12/2015 | Klemmensen |
| 9,208,769 | B2 | 12/2015 | Azmi |
| 9,208,771 | B2 | 12/2015 | Zhou et al. |
| 9,226,066 | B2 | 12/2015 | Ohta et al. |
| 9,226,068 | B2 | 12/2015 | Hendrix et al. |
| 9,230,532 | B1 | 1/2016 | Lu et al. |
| 9,253,560 | B2 | 2/2016 | Goldstein et al. |
| 9,264,808 | B2 | 2/2016 | Zhou et al. |
| 9,291,697 | B2 | 3/2016 | Kim et al. |
| 9,294,836 | B2 | 3/2016 | Zhou et al. |
| 9,478,212 | B1 | 10/2016 | Sorensen et al. |
| 2001/0053228 | A1 | 12/2001 | Jones |
| 2004/0017921 | A1 | 1/2004 | Mantovani |
| 2005/0018862 | A1 | 1/2005 | Fisher |
| 2005/0117754 | A1 | 6/2005 | Sakawaki |
| 2006/0013408 | A1 | 1/2006 | Lee |
| 2006/0018460 | A1 | 1/2006 | McCree |
| 2006/0035593 | A1 | 2/2006 | Leeds |
| 2006/0055910 | A1 | 3/2006 | Lee |
| 2006/0153400 | A1 | 7/2006 | Fujita et al. |
| 2006/0159282 | A1 | 7/2006 | Borsch |
| 2006/0161428 | A1 | 7/2006 | Fouret |
| 2006/0251266 | A1 | 11/2006 | Saunders et al. |
| 2007/0033029 | A1 | 2/2007 | Sakawaki |
| 2007/0047742 | A1 | 3/2007 | Taenzer et al. |
| 2007/0076896 | A1 | 4/2007 | Hosaka et al. |
| 2007/0208520 | A1 | 9/2007 | Zhang et al. |
| 2007/0258597 | A1 | 11/2007 | Rasmussen et al. |
| 2007/0297620 | A1 | 12/2007 | Choy |
| 2009/0034748 | A1 | 2/2009 | Sibbald |
| 2009/0175461 | A1 | 7/2009 | Nakamura et al. |
| 2010/0014683 | A1 | 1/2010 | Maeda et al. |
| 2010/0014685 | A1 | 1/2010 | Wurm |
| 2010/0061564 | A1 | 3/2010 | Clemow et al. |
| 2010/0082339 | A1 | 4/2010 | Konchitsky et al. |
| 2010/0124335 | A1 | 5/2010 | Wessling et al. |
| 2010/0166203 | A1 | 7/2010 | Peissig et al. |
| 2010/0166206 | A1 | 7/2010 | Macours |
| 2010/0226210 | A1 | 9/2010 | Kordis et al. |
| 2010/0284546 | A1 | 11/2010 | DeBrunner et al. |
| 2010/0296666 | A1 | 11/2010 | Lin |
| 2010/0310086 | A1 | 12/2010 | Magrath et al. |
| 2011/0026724 | A1 | 2/2011 | Doclo |
| 2011/0091047 | A1 | 4/2011 | Konchitsky et al. |
| 2011/0099010 | A1 | 4/2011 | Zhang |
| 2011/0116654 | A1 | 5/2011 | Chan et al. |
| 2011/0288860 | A1 | 11/2011 | Schevciw et al. |
| 2011/0317848 | A1 | 12/2011 | Ivanov et al. |
| 2012/0135787 | A1 | 5/2012 | Kusunoki et al. |
| 2012/0140917 | A1 | 6/2012 | Nicholson et al. |
| 2012/0155666 | A1 | 6/2012 | Nair |
| 2012/0179458 | A1 | 7/2012 | Oh et al. |
| 2012/0263317 | A1 | 10/2012 | Shin et al. |
| 2012/0281850 | A1 | 11/2012 | Hyatt |
| 2012/0300960 | A1 | 11/2012 | Mackay et al. |
| 2012/0308025 | A1 | 12/2012 | Hendrix et al. |
| 2012/0308027 | A1 | 12/2012 | Kwatra |
| 2012/0308028 | A1 | 12/2012 | Kwatra et al. |
| 2013/0010982 | A1 | 1/2013 | Elko et al. |
| 2013/0156238 | A1 | 6/2013 | Birch et al. |
| 2013/0243198 | A1 | 9/2013 | Van Rumpt |
| 2013/0243225 | A1 | 9/2013 | Yokota |
| 2013/0301846 | A1 | 11/2013 | Alderson et al. |
| 2013/0301848 | A1 | 11/2013 | Zhou et al. |

(56) References Cited

U.S. PATENT DOCUMENTS

| | | | |
|---|---|---|---|
| 2013/0315403 | A1 | 11/2013 | Samuelsson |
| 2013/0343571 | A1 | 12/2013 | Rayala et al. |
| 2014/0016803 | A1 | 1/2014 | Puskarich |
| 2014/0036127 | A1 | 2/2014 | Pong et al. |
| 2014/0044275 | A1 | 2/2014 | Goldstein et al. |
| 2014/0086425 | A1 | 3/2014 | Jensen et al. |
| 2014/0146976 | A1 | 5/2014 | Rundle |
| 2014/0177851 | A1 | 6/2014 | Kitazawa et al. |
| 2014/0177890 | A1 | 6/2014 | Hojlund et al. |
| 2014/0211953 | A1 | 7/2014 | Alderson et al. |
| 2014/0270222 | A1 | 9/2014 | Hendrix et al. |
| 2014/0294182 | A1 | 10/2014 | Axelsson et al. |
| 2014/0307887 | A1 | 10/2014 | Alderson |
| 2014/0307888 | A1 | 10/2014 | Alderson et al. |
| 2014/0314244 | A1 | 10/2014 | Yong |
| 2014/0314246 | A1 | 10/2014 | Hellman |
| 2014/0314247 | A1 | 10/2014 | Zhang |
| 2014/0341388 | A1 | 11/2014 | Goldstein |
| 2015/0092953 | A1 | 4/2015 | Abdollahzadeh Milani et al. |
| 2015/0104032 | A1 | 4/2015 | Kwatra et al. |
| 2015/0161980 | A1 | 6/2015 | Alderson et al. |
| 2015/0161981 | A1 | 6/2015 | Kwatra |
| 2015/0163592 | A1 | 6/2015 | Alderson |
| 2015/0195646 | A1 | 7/2015 | Kumar et al. |
| 2015/0256660 | A1 | 9/2015 | Kaller et al. |
| 2015/0256953 | A1 | 9/2015 | Kwatra et al. |
| 2015/0269926 | A1 | 9/2015 | Alderson et al. |
| 2015/0296296 | A1 | 10/2015 | Lu et al. |
| 2015/0365761 | A1 | 12/2015 | Alderson et al. |
| 2016/0063988 | A1 | 3/2016 | Hendrix et al. |

FOREIGN PATENT DOCUMENTS

| | | | |
|---|---|---|---|
| EP | 0412902 | A2 | 2/1991 |
| EP | 0756407 | A2 | 1/1997 |
| EP | 0898266 | A2 | 2/1999 |
| EP | 1691577 | A2 | 8/2006 |
| EP | 1880699 | A2 | 1/2008 |
| EP | 1921603 | A2 | 5/2008 |
| EP | 1947642 | A1 | 7/2008 |
| EP | 2133866 | A1 | 12/2009 |
| EP | 2216774 | A1 | 8/2010 |
| EP | 2237573 | A1 | 10/2010 |
| EP | 2259250 | A1 | 12/2010 |
| EP | 2395500 | A1 | 12/2011 |
| EP | 2395501 | A1 | 12/2011 |
| EP | 2551845 | A1 | 1/2013 |
| GB | 2401744 | A | 11/2004 |
| GB | 2436657 | A | 10/2007 |
| GB | 2455821 | A | 6/2009 |
| GB | 2455824 | A | 6/2009 |
| GB | 2455828 | A | 6/2009 |
| GB | 2484722 | A | 4/2012 |
| GB | 2539280 | A | 12/2016 |
| JP | 52071502 | | 5/1977 |
| JP | 03162099 | | 7/1991 |
| JP | H05265468 | | 10/1993 |
| JP | 05341792 | | 12/1993 |
| JP | 06006246 | | 1/1994 |
| JP | h06-186985 | a | 7/1994 |
| JP | H06232755 | | 8/1994 |
| JP | 07098592 | | 4/1995 |
| JP | 07104769 | | 4/1995 |
| JP | H017106886 | A | 4/1995 |
| JP | 07240989 | | 9/1995 |
| JP | 07325588 | | 12/1995 |
| JP | H07334169 | | 12/1995 |
| JP | H08227322 | | 9/1996 |
| JP | H10247088 | | 9/1998 |
| JP | H10257159 | | 9/1998 |
| JP | 10294989 | | 11/1998 |
| JP | H11305783 | A | 11/1999 |
| JP | 2000089770 | | 3/2000 |
| JP | 2002010355 | | 1/2002 |
| JP | 2004007107 | | 1/2004 |
| JP | 2006217542 | A | 8/2006 |
| JP | 2007003994 | | 1/2007 |
| JP | 2007060644 | | 3/2007 |
| JP | 2007175486 | | 7/2007 |
| JP | 2008015046 | A | 1/2008 |
| JP | 2010277025 | | 12/2010 |
| JP | 2011055494 | | 3/2011 |
| JP | 2011061449 | | 3/2011 |
| WO | WO 199113429 | | 9/1991 |
| WO | WO 1993004529 | | 3/1993 |
| WO | WO 1994007212 | | 3/1994 |
| WO | WO 1999011045 | | 3/1999 |
| WO | WO 2003015074 | A1 | 2/2003 |
| WO | WO 2003015275 | A1 | 2/2003 |
| WO | WO 2004009007 | A1 | 1/2004 |
| WO | WO 2004017303 | A1 | 2/2004 |
| WO | WO 2006125061 | A1 | 11/2006 |
| WO | WO 2006128768 | A1 | 12/2006 |
| WO | WO 2007007916 | A1 | 1/2007 |
| WO | WO 2007011337 | | 1/2007 |
| WO | WO 2007110807 | A2 | 10/2007 |
| WO | WO 2007113487 | A1 | 11/2007 |
| WO | WO 2009041012 | A1 | 4/2009 |
| WO | WO 2009110087 | A1 | 9/2009 |
| WO | WO 2009155696 | A1 | 12/2009 |
| WO | WO 2010117714 | A1 | 10/2010 |
| WO | WO 2010131154 | A1 | 11/2010 |
| WO | WO 2012134874 | A1 | 10/2012 |
| WO | WO-2013106370 | A1 | 7/2013 |
| WO | WO 2015038255 | A1 | 3/2015 |
| WO | WO 2015088639 | A1 | 6/2015 |
| WO | WO 2015088651 | A1 | 6/2015 |
| WO | WO 2016054186 | A1 | 4/2016 |
| WO | WO-2016100602 | A1 | 6/2016 |

OTHER PUBLICATIONS

Lopez-Caudana, et al., "A Hybrid Noise Cancelling Algorithm with Secondary Path Estimation", WSEAS Transactions on Signal Processing, vol. 4, No. 12, Dec. 2008, pp. 677-687, Mexico.

Goeckler, H.G. et al., "Efficient Multirate Digital Filters Based on Fractional Polyphase Decomposition for Subnyquist Processing", Proceedings of the European Conference on Circuit Theory & Design, vol. 1, Jan. 1, 1999, pp. 409-412.

U.S. Appl. No. 13/686,353, filed Nov. 27, 2012, Hendrix et al.

U.S. Appl. No. 13/794,979, filed Mar. 12, 2013, Alderson et al.

U.S. Appl. No. 14/210,537, filed Mar. 14, 2014, Abdollahzadeh Milani et al.

U.S. Appl. No. 14/210,589, filed Mar. 14, 2014, Abdollahzadeh Milani et al.

U.S. Appl. No. 13/721,832, filed Dec. 20, 2012, Lu et al.

U.S. Appl. No. 13/968,013, filed Aug. 15, 2013, Abdollahzadeh Milani et al.

U.S. Appl. No. 15/070,564, filed Mar. 15, 2016, Zhou, et al.

U.S. Appl. No. 15/130,271, filed Apr. 15, 2016, Hendrix et al.

U.S. Appl. No. 15/202,644, filed Jul. 6, 2016, Hendrix et al.

U.S. Appl. No. 14/832,585, filed Aug. 21, 2015, Zhou.

Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.

Toochinda, et al. "A Single-Input Two-Output Feedback Formulation for ANC Problems," Proceedings of the 2001 American Control Conference, Jun. 2001, pp. 923-928, vol. 2, Arlington, VA.

Kuo, et al., "Active Noise Control: A Tutorial Review," Proceedings of the IEEE, Jun. 1999, pp. 943-973, vol. 87, No. 6, IEEE Press, Piscataway, NJ.

Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.

Mali, Dilip, "Comparison of DC Offset Effects on LMS Algorithm and its Derivatives," International Journal of Recent Trends in Engineering, May 2009, pp. 323-328, vol. 1, No. 1, Academy Publisher.

(56) References Cited

OTHER PUBLICATIONS

Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages (pp. 1-12 in pdf), Pensacola, FL, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pp. (pp. 1-13 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 10 pages (pp. 1-10 in pdf), Santa Barbara, CA, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Abdollahzadeh Milani, et al., "On Maximum Achievable Noise Reduction in ANC Systems",2010 IEEE International Conference on Acoustics Speech and Signal Processing, Mar. 14-19, 2010, pp. 349-352, Dallas, TX, US.
Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.
Ryan, et al., "Optimum Near-Field Performance of Microphone Arrays Subject to a Far-Field Beampattern Constraint", J. Acoust. Soc. Am., Nov. 2000, pp. 2248-2255, 108 (5), Pt. 1, Ottawa, Ontario, Canada.
Cohen, et al., "Noise Estimation by Minima Controlled Recursive Averaging for Robust Speech Enhancement", IEEE Signal Processing Letters, Jan. 2002, pp. 12-15, vol. 9, No. 1, Piscataway, NJ, US.
Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.
Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.
Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.
Kuo, et al., "Residual noise shaping technique for active noise control systems", J. Acoust. Soc. Am. 95 (3), Mar. 1994, pp. 1665-1668.
Lopez-Gaudana, Edgar Omar, "Active Noise Cancellation: The Unwanted Signal and The Hybrid Solution", Adaptive Filtering Applications, Dr. Lino Garcia (Ed.), Jul. 2011, pp. 49-84, ISBN: 978-953-307-306-4, InTech.
Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.
Hurst, et al., "An improved double sampling scheme for switched-capacitor delta-sigma modulators", 1992 IEEE Int. Symp. on Circuits and Systems, May 10-13, 1992, vol. 3, pp. 1179-1182, San Diego, CA.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
Jin, et al. "A simultaneous equation method-based online secondary path modeling algorithm for active noise control", Journal of Sound and Vibration, Apr. 25, 2007, pp. 455-474, vol. 303, No. 3-5, London, GB.
Erkelens, et al., "Tracking of Nonstationary Noise Based on Data-Driven Recursive Noise Power Estimation", IEEE Transactions on Audio Speech and Language Processing, Aug. 2008, pp. 1112-1123, vol. 16, No. 6, Piscataway, NJ, US.
Rao, et al., "A Novel Two State Single Channel Speech Enhancement Technique", India Conference (INDICON) 2011 Annual IEEE, IEEE, Dec. 2011, 6 pages (pp. 1-6 in pdf), Piscataway, NJ, US.
Rangachari, et al., "A noise-estimation algorithm for highly non-stationary environments", Speech Communication, Feb. 2006, pp. 220-231, vol. 48, No. 2. Elsevier Science Publishers.
Parkins, et al., "Narrowband and broadband active control in an enclosure using the acoustic energy density", J. Acoust. Soc. Am. Jul. 2000, pp. 192-203, vol. 108, issue 1, US.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B., et al., Adaptive Noise Cancelling; Principles and Applications, Proceedings of the IEEE, Dec. 1975, pp. 1692-1716, vol. 63, No. 13, IEEE, New York, NY, US.
Morgan, et al., A Delayless Subband Adaptive Filter Architecture, IEEE Transactions on Signal Processing, IEEE Service Center, Aug. 1995, pp. 1819-1829, vol. 43, No. 8, New York, NY, US.
Rafaely, Boaz, "Active Noise Reducing Headset—an Overview", The 2001 International Congress and Exhibition on Noise Control Engineering, Aug. 27-30, 2001, 10 pages (pp. 1-10 in pdf), The Netherlands.
Ray, et al., "Hybrid Feedforward-Feedback Active Noise Reduction for Hearing Protection and Communication", The Journal of the

(56) References Cited

OTHER PUBLICATIONS

Acoustical Society of America, American Institute of Physics for the Acoustical Society of America, Jan. 2006, pp. 2026-2036, vol. 120, No. 4, New York, NY.
International Search Report and Written Opinion in PCT/IB2016/001234 dated Nov. 4, 2016, 13 pages (pp. 1-13 in pdf).

FEEDBACK ADAPTIVE NOISE CANCELLATION (ANC) CONTROLLER AND METHOD HAVING A FEEDBACK RESPONSE PARTIALLY PROVIDED BY A FIXED-RESPONSE FILTER

This U.S. Patent Application Claims priority under 35 U.S.C. § 119(e) to U.S. Provisional Patent Application Ser. No. 62/207,657 filed on Aug. 20, 2015.

BACKGROUND OF THE INVENTION

1. Field of the Invention

The field of representative embodiments of this disclosure relates to methods and systems for adaptive noise cancellation (ANC), and in particular to an ANC feedback controller in which the feedback response is provided by a fixed transfer function feedback filter and a variable response filter.

2. Background of the Invention

Wireless telephones, such as mobile/cellular telephones, cordless telephones, and other consumer audio devices, such as MP3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

In many noise cancellation systems, it is desirable to include both feed-forward noise cancellation by using a feed-forward adaptive filter for generating a feed-forward anti-noise signal from a reference microphone signal configured to measure ambient sounds and feedback noise cancellation by using a fixed-response feedback filter for generating a feedback noise cancellation signal to be combined with the feed-forward anti-noise signal. In other noise cancellation systems, only feedback noise cancellation is provided. An adaptive feedback noise cancelling system includes an adaptive filter that generates an anti-noise signal from an output of a sensor that senses the noise to be canceled and that is provided to an output transducer for reproduction to cancel the noise.

In any ANC system having a feedback noise-canceling path, the secondary path, which is the electro-acoustic path at least extending from the output transducer that reproduces the anti-noise signal generated by the ANC system to the output signal provided by the input sensor that measures the ambient noise to be canceled, determines a portion of the necessary feedback response to provide proper noise-canceling. In ANC systems in which the acoustic environment around the output transducer and input sensor varies greatly, such as in a mobile telephone where the telephone's position with respect to the user's ear changes the coupling between the telephone's speaker and a microphone used to measure the ambient noise, the secondary path response varies as well. Since the feedback path transfer function for generating a proper anti-noise signal is dependent on the secondary path response, it is difficult to provide an ANC controller that is stable for all possible configurations of the acoustic path between the output transducer and input sensor that may be present in an actual implementation.

Therefore, it would be desirable to provide an ANC controller with improved stability in ANC feedback and feed-forward/feedback ANC systems.

SUMMARY OF THE INVENTION

The above-stated objective of providing an ANC controlled with improved stability, is accomplished in an ANC controller, a method of operation, and an integrated circuit.

The ANC controller includes a fixed filter having a predetermined fixed transfer function and a variable-response filter coupled together. The fixed transfer function relates to and maintains stability of a compensated feedback loop and contributes to an ANC gain of the ANC system. The response of the variable-response filter compensates for variation of a transfer function of a secondary path that includes at least a path from a transducer of the ANC system to a sensor of the ANC system, so that the ANC gain is independent of the variation of the transfer function of the secondary path.

The description below sets forth example embodiments according to this disclosure. Further embodiments and implementations will be apparent to those having ordinary skill in the art. Persons having ordinary skill in the art will recognize that various equivalent techniques may be applied in lieu of, or in conjunction with, the embodiments discussed below, and all such equivalents are encompassed by the present disclosure.

DESCRIPTION OF ILLUSTRATIVE EMBODIMENT

The present disclosure encompasses noise canceling techniques and circuits that can be implemented in a personal audio device, such as a wireless telephone, tablet, note-book computer, noise-canceling headphones, as well as in other noise-canceling circuits. The personal audio device includes an ANC circuit that measures the ambient acoustic environment with a sensor and generates an anti-noise signal that is output via a speaker or other transducer to cancel ambient acoustic events. The example ANC circuits shown herein include a feedback filter and may include a feed-forward filter that are used to generate the anti-noise signal from the sensor output. A secondary path, including the acoustic path from the transducer back to the sensor, closes a feedback loop around an ANC feedback path that extends through the feedback filter, and thus the stability of the feedback loop is dependent on the characteristics of the secondary path. The secondary path involves structures around and between the transducer and sensor, thus for devices such as a wireless telephone, the response of the secondary path varies with the user and the position of the device with respect to the user's ear(s). To provide stability over a range of variable secondary paths, the instant disclosure uses a pair of filters, one having a fixed predetermined response and the other having a variable response that compensates for secondary path variations. The fixed predetermined response is selected to provide stability over the range of secondary path responses expected for the device, contributes to the acoustic noise cancellation and generally maximizes the range over which the acoustic noise cancelation operates.

Figure 1A:
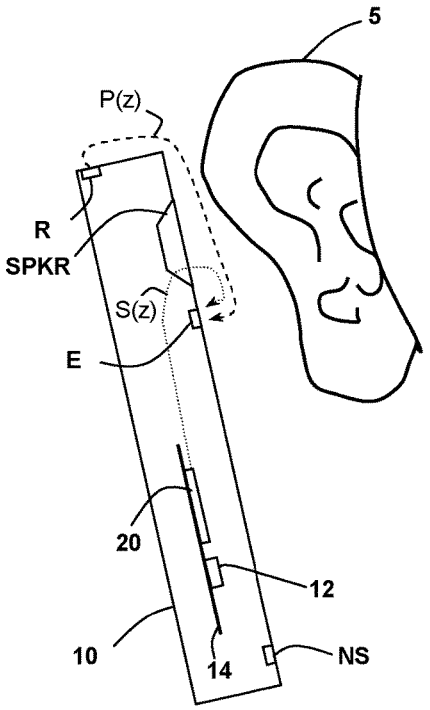
FIG. 1A is an illustration of a wireless telephone 10, which is an example of a personal audio device in which the techniques disclosed herein can be implemented.

Referring now to FIG. 1A, an exemplary wireless telephone 10 is shown in proximity to a human ear 5. Illustrated wireless telephone 10 is an example of a device in which techniques illustrated herein may be employed, but it is understood that not all of the elements or configurations embodied in illustrated wireless telephone 10, or in the circuits depicted in subsequent illustrations, are required to practice what is claimed. Wireless telephone 10 includes a transducer such as speaker SPKR that reproduces distant speech received by wireless telephone 10, along with other local audio events such as ringtones, stored audio program material, near-end speech (i.e., the speech of the user of wireless telephone 10), sources from web-pages or other network communications received by wireless telephone 10 and audio indications such as battery low and other system event notifications. A near-speech microphone NS is provided to capture near-end speech, which is transmitted from wireless telephone 10 to the other conversation participant (s).

Wireless telephone 10 includes adaptive noise canceling (ANC) circuits and features that inject an anti-noise signal into speaker SPKR to improve intelligibility of the distant speech and other audio reproduced by speaker SPKR. A reference microphone R may be provided for measuring the ambient acoustic environment and is positioned away from the typical position of a user's mouth, so that the near-end speech is minimized in the signal produced by reference microphone R. A third microphone, error microphone E, may be provided in order to further improve the ANC operation by providing a measure of the ambient audio combined with the audio reproduced by speaker SPKR close to ear 5, when wireless telephone 10 is in proximity to ear 5. A circuit 14 within wireless telephone 10 may include an audio CODEC integrated circuit 20 that receives the signals from reference microphone R, near-speech microphone NS, and error microphone E and interfaces with other integrated circuits such as an RF integrated circuit 12 containing the wireless telephone transceiver. In some embodiments of the disclosure, the circuits and techniques disclosed herein may be incorporated in a single integrated circuit that contains control circuits and other functionality for implementing the entirety of the personal audio device, such as an MP3 player-on-a-chip integrated circuit. In the depicted embodiments and other embodiments, the circuits and techniques disclosed herein may be implemented partially or fully in software and/or firmware embodied in computer-readable storage media and executable by a processor circuit or other processing device such as a microcontroller.

In general, the ANC techniques disclosed herein measure ambient acoustic events (as opposed to the output of speaker SPKR and/or the near-end speech) impinging on error microphone E and/or reference microphone R. The ANC processing circuits of illustrated wireless telephone 10 adapt an anti-noise signal generated from the output of error microphone E and/or reference microphone R to have a characteristic that minimizes the amplitude of the ambient acoustic events present at error microphone E. Since acoustic path P(z) extends from reference microphone R to error microphone E, the ANC circuits are effectively estimating acoustic path P(z) combined with removing effects of an electro-acoustic path S(z). Electro-acoustic path S(z) represents the response of the audio output circuits of CODEC IC 20 and the acoustic/electric transfer function of speaker SPKR including the coupling between speaker SPKR and error microphone E in the particular acoustic environment. Electro-acoustic path S(z) is affected by the proximity and structure of ear 5 and other physical objects and human head structures that may be in proximity to wireless telephone 10, when wireless telephone 10 is not firmly pressed to ear 5. While the illustrated wireless telephone 10 includes a two microphone ANC system with a third near-speech microphone NS, other systems that do not include separate error and reference microphones can implement the above-described techniques. Alternatively, near-speech microphone NS can be used to perform the function of the reference microphone R in the above-described system. Also, in personal audio devices designed only for audio playback, near-speech microphone NS will generally not be included, and the near-speech signal paths in the circuits described in further detail below can be omitted without changing the scope of the disclosure. Also, the techniques disclosed herein can be applied in purely noise-canceling systems that do not reproduce a playback signal or conversation using the output transducer, i.e., those systems that only reproduce an anti-noise signal.

Figure 1B:
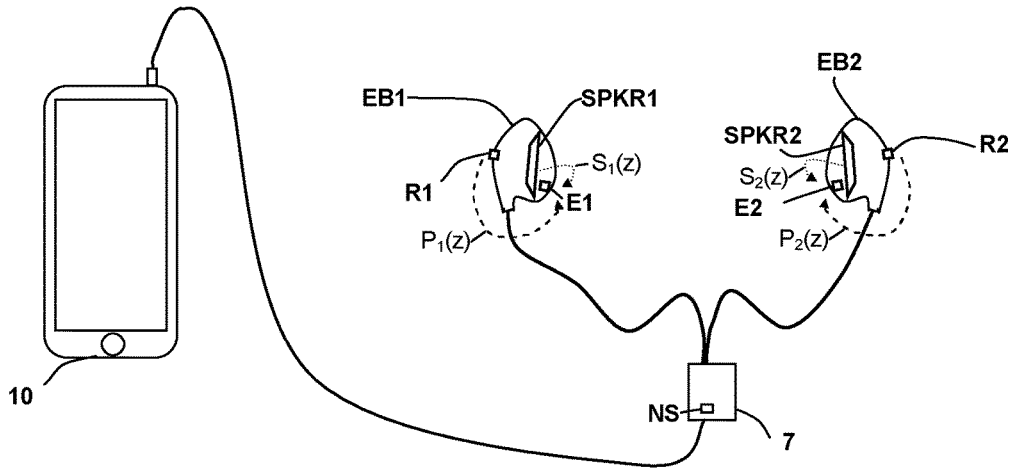
FIG. 1B is an illustration of a wireless telephone 10 coupled to a pair of earbuds EB1 and EB2, which is an example of a personal audio system in which the techniques disclosed herein can be implemented.

Referring now to FIG. 1B, another wireless telephone configuration in which the techniques disclosed herein is shown. FIG. 1B shows wireless telephone 10 and a pair of earbuds EB1 and EB2, each attached to a corresponding ear of a listener. Illustrated wireless telephone 10 is an example of a device in which the techniques herein may be employed, but it is understood that not all of the elements or configurations illustrated in wireless telephone 10, or in the circuits depicted in subsequent illustrations, are required. Wireless telephone 10 is connected to earbuds EB1, EB2 by a wired or wireless connection, e.g., a BLUETOOTH™ connection (BLUETOOTH is a trademark of Bluetooth SIG, Inc.). Earbuds EB1, EB2 each have a corresponding transducer, such as speaker SPKR1, SPKR2, which reproduce source audio including distant speech received from wireless telephone 10, ringtones, stored audio program material, and injection of near-end speech (i.e., the speech of the user of wireless telephone 10). The source audio also includes any other audio that wireless telephone 10 is required to reproduce, such as source audio from web-pages or other network communications received by wireless telephone 10 and audio indications such as battery low and other system event notifications. Reference microphones R1, R2 are provided on a surface of the housing of respective earbuds EB1, EB2 for measuring the ambient acoustic environment. Another pair of microphones, error microphones E1, E2, are provided in order to further improve the ANC operation by providing a measure of the ambient audio combined with the audio reproduced by respective speakers SPKR1, SPKR2 close to corresponding ears 5A, 5B, when earbuds EB1, EB2 are inserted in the outer portion of ears 5A, 5B. As in wireless telephone 10 of FIG. 1A, wireless telephone 10 includes adaptive noise canceling (ANC) circuits and features that inject an anti-noise signal into speakers SPKR1, SPKR2 to improve intelligibility of the distant speech and other audio reproduced by speakers SPKR1, SPKR2. In the depicted example, an ANC circuit within wireless telephone 10 receives the signals from reference microphones R1, R2 and error microphones E1, E2. Alternatively, all or a portion of the ANC circuits disclosed herein may be incorporated within earbuds EB1, EB2. For example, each of earbuds EB1, EB2 may constitute a stand-alone acoustic noise canceler including a separate ANC circuit. Near-speech microphone NS may be provided on the outer surface of a housing of one of earbuds EB1, EB2, on a boom affixed to one of earbuds EB1, EB2, or on a combox pendant 7 located between wireless telephone 10 and either or both of earbuds EB1, EB2, as shown.

As described above with reference to FIG. 1A, the ANC techniques illustrated herein measure ambient acoustic events (as opposed to the output of speakers SPKR1, SPKR2 and/or the near-end speech) impinging on error microphones E1, E2 and/or reference microphones R1, R2. In the embodiment depicted in FIG. 1B, the ANC processing circuits of integrated circuits within earbuds EB1, EB2, or alternatively within wireless telephone 10 or combox pendant 7, individually adapt an anti-noise signal generated from the output of the corresponding reference microphone R1, R2 to have a characteristic that minimizes the amplitude of the ambient acoustic events at the corresponding error microphone E1, E2. Since acoustic path $P_1(z)$ extends from reference microphone R1 to error microphone E, the ANC circuit in audio integrated circuit 20A is essentially estimating acoustic path $P_1(z)$ combined with removing effects of an electro-acoustic path $S_1(z)$ that represents the response of the audio output circuits of audio integrated circuit 20A and the acoustic/electric transfer function of speaker SPKR1. The estimated response includes the coupling between speaker SPKR1 and error microphone E1 in the particular acoustic environment which is affected by the proximity and structure of ear 5A and other physical objects and human head structures that may be in proximity to earbud EB1. Similarly, audio integrated circuit 20B estimates acoustic path $P_2(z)$ combined with removing effects of an electro-acoustic path $S_2(z)$ that represents the response of the audio output circuits of audio integrated circuit 20B and the acoustic/electric transfer function of speaker SPKR2. As used in this disclosure, the terms "headphone" and "speaker" refer to any acoustic transducer intended to be mechanically held in place proximate to a user's ear canal and include, without limitation, earphones, earbuds, and other similar devices. As more specific examples, "earbuds" or "headphones" may refer to intra-concha earphones, supra-concha earphones and supra-aural earphones. Further, the techniques disclosed herein are applicable to other forms of acoustic noise canceling, and the term "transducer" includes headphone or speaker type transducers, but also other vibration generators such as piezo-electric transducers, magnetic vibrators such as motors, and the like. The term "sensor" includes microphones, but also includes vibration sensors such as piezo-electric films, and the like.

Figure 2:
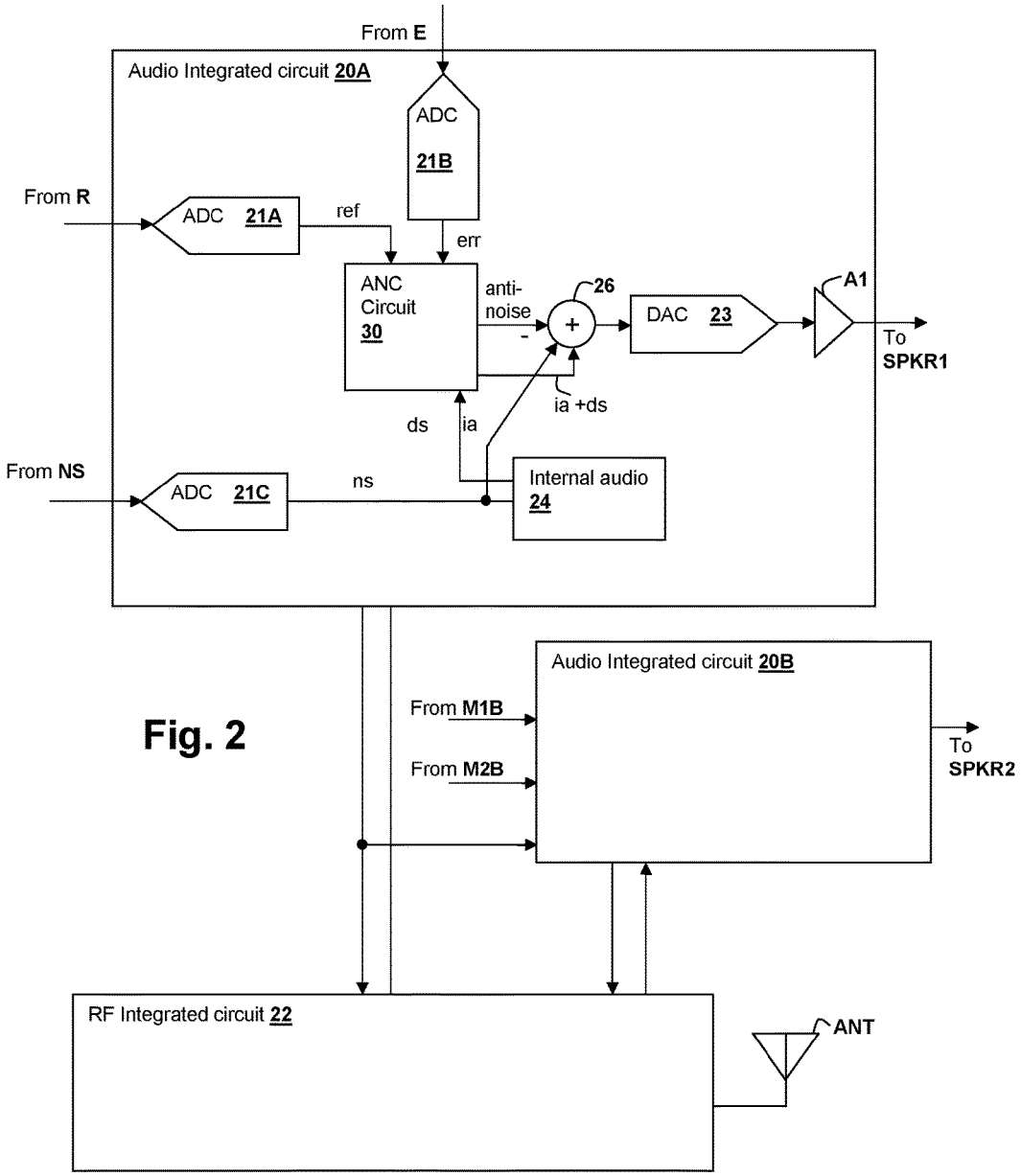
FIG. 2 is a block diagram of circuits within wireless telephone 10 and/or earbud EB of FIG. 1A.

FIG. 2 shows a simplified schematic diagram of audio integrated circuits 20A, 20B that include ANC processing, as coupled to respective reference microphones R1, R2, which provides measurements of ambient audio sounds that are filtered by the ANC processing circuits within audio integrated circuits 20A, 20B, located within corresponding earbuds EB1, EB2. In purely feedback implementations, reference microphone R may be omitted and the anti-noise signal generated entirely from error microphones E1, E2. Audio integrated circuits 20A, 20B may be alternatively combined in a single integrated circuit, such as integrated circuit 20 within wireless telephone 10. Further, while the connections shown in FIG. 2 apply to the wireless telephone system depicted in FIG. 1B, the circuits disclosed in FIG. 2 are applicable to wireless telephone 10 of FIG. 1A by omitting audio integrated circuit 20B, so that a single reference microphone input is provided for each of reference microphone R and error microphone E and a single output is provided for speaker SPKR. Audio integrated circuits 20A, 20B generate outputs for their corresponding channels that are provided to the corresponding one of speakers SPKR1, SPKR2. Audio integrated circuits 20A, 20B receive the signals (wired or wireless depending on the particular configuration) from reference microphones R1, R2, near-speech microphone NS and error microphones E1, E2. Audio integrated circuits 20A, 20B also interface with other integrated circuits such as RF integrated circuit 12 containing the wireless telephone transceiver shown in FIG. 1A. In other configurations, the circuits and techniques disclosed herein may be incorporated in a single integrated circuit that contains control circuits and other functionality for implementing the entirety of the personal audio device, such as an MP3 player-on-a-chip integrated circuit. Alternatively, multiple integrated circuits may be used, for example, when a wireless connection is provided from each of earbuds EB1, EB2 to wireless telephone 10 and/or when some or all of the ANC processing is performed within earbuds EB1, EB2 or a module disposed along a cable connecting wireless telephone 10 to earbuds EB1, EB2.

Audio integrated circuit 20A includes an analog-to-digital converter (ADC) 21A for receiving the reference microphone signal from reference microphone R1 (or reference microphone R in FIG. 1A) and generating a digital representation ref of the reference microphone signal. Audio integrated circuit 20A also includes an ADC 21B for receiving the error microphone signal from error microphone E1 (or error microphone E in FIG. 1A) and generating a digital representation err of the error microphone signal, and an ADC 21C for receiving the near-speech microphone signal from near-speech microphone NS and generating a digital representation of near-speech microphone signal ns. (In the dual earbud system of FIG. 1B, audio integrated circuit 20B receives the digital representation of near-speech microphone signal ns from audio integrated circuit 20A via the wireless or wired connections as described above.) Audio integrated circuit 20A generates an output for driving speaker SPKR1 from amplifier A1, which amplifies the output of a digital-to-analog converter (DAC) 23 that receives the output of a combiner 26. Combiner 26 combines audio signals ia from internal audio sources 24, and the anti-noise signal anti-noise generated by an ANC circuit 30, which by convention has the same polarity as the noise in error microphone signal err and reference microphone signal ref and is therefore subtracted by combiner 26. Combiner 26 also combines an attenuated portion of near-speech signal ns, i.e., sidetone information st, so that the user of wireless telephone 10 hears their own voice in proper relation to downlink speech ds, which is received from a radio frequency (RF) integrated circuit 22. Near-speech signal ns is also provided to RF integrated circuit 22 and is transmitted as uplink speech to the service provider via an antenna ANT.

Figure 3A:
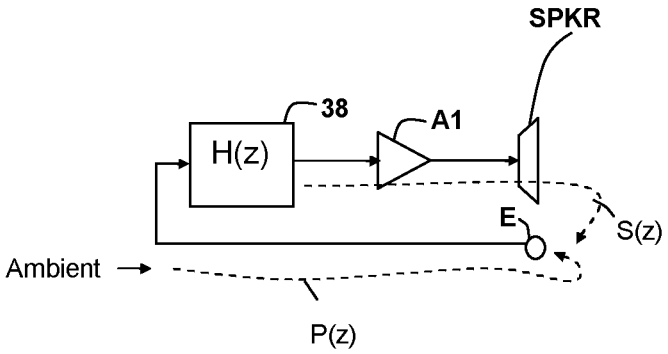
FIG. 3A is an illustration of electrical and acoustical signal paths in FIG. 1A and FIG. 1B including a feedback acoustic noise canceler.

Referring now to FIG. 3A, a simplified feedback ANC circuit is shown which applies in examples of the wireless telephone shown in FIG. 1A, and to each channel of the wireless telephone system shown in FIG. 1B. Ambient sounds Ambient travel along a primary path P(z) to error microphone E and are filtered by a feedback filter 38 to generate anti-noise provided through amplifier A1 to speaker SPKR. Secondary path S(z) includes the electrical path from the output of feedback filter 38 to speaker SPKR combined with the acoustic path from the speaker SPKR through error microphone E to the input of feedback filter 38. Secondary path S(z) and feedback filter 38 constitute a feedback loop with a feedback gain $G_{FB}(z)=1/(1+H(z)S(z))=Q(z)/(\text{Ambient}*P(z))$, where Q(z) is the error microphone signal. Q(z) is corrected, if needed, to remove any playback audio that is not the anti-noise signal. Thus, the feedback gain $G_{FB}(z)$, which determines the effectiveness of the acoustic noise canceling, is dependent on the response of secondary path S(z) and the transfer function H(z) of feedback filter 38. Since $G_{FB}(z)$ varies with the response of secondary path S(z), an ANC feedback controller must generally be designed using multiple models representing extreme values of the response of secondary path S(z) and H(z) must be conservatively designed in order to maintain a proper phase margin (i.e., the phase between the ambient sounds and the anti-noise reproduced by speaker SPKR at an upper frequency bound at which the G(z) falls to unity) and gain margin (i.e., the attenuation relative to unity of the ambient sounds and the anti-noise reproduced by speaker SPKR at one or more frequencies for which the phase between the ambient sounds and the anti-noise reaches zero, causing positive feedback). A proper phase margin/gain margin are necessary for stability of the feedback loop in an ANC system employing feedback, as the phase margin/gain margin are directly determinative of the recovery of the ANC system from a disturbance, such as high-amplitude noise, or noise that the ANC system cannot cancel. On the other hand, increasing the gain and phase margins typically requires lowering the upper limit of the frequency response of the feedback loop, reducing the ability of the ANC system to cancel ambient noise. A wide variation in the response of secondary path S(z) constrains any off-line design of the feedback controller such that the performance of the feedback cancelation is limited at higher frequencies. A wide variation in the response of secondary path S(z) is typical for wireless telephones, earbuds, and the other devices described above, which are used in or in proximity to a user's ear canal.

Figure 3B:
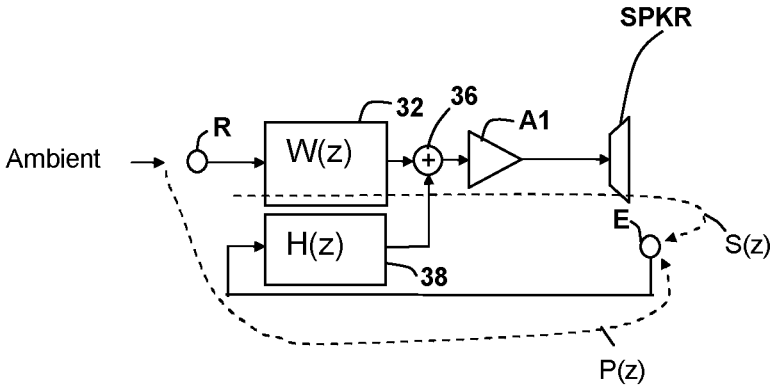
FIG. 3B is an illustration of electrical and acoustical signal paths in FIG. 1A and FIG. 1B including a hybrid feed-forward/feedback acoustic noise canceler.

Referring now to FIG. 3B, a simplified feed-forward/feedback ANC circuit is shown which alternatively applies to the wireless telephone shown in FIG. 1A, and to each channel of the wireless telephone system shown in FIG. 1B. The operation of the feed-forward/feedback ANC is similar to the pure feedback approach shown in FIG. 3A, except that the anti-noise signal provided to amplifier A1 is generated by both the feedback filter 38 described above, and a feed-forward filter 32, which generates a portion of the anti-noise signal from the output of reference microphone R. Combiner 36 combines the feed-forward anti-noise with the feedback anti-noise. The feedback gain of feedback filter 38 is still $G_{FB}(z)=1/(1+H(z)S(z))=Q(z)/(\text{Ambient}*P(z))$.

Referring now to FIGS. 4A-4D, details of various exemplary ANC circuits 20 that may be included within audio integrated circuits 20A, 20B of FIG. 2, are shown in accordance with various embodiments of the disclosure. In each of the examples, the above-described feedback filter 38 is implemented as a pair of filters. A first filter 40 has a fixed predetermined response that is related to and helps maintain stability of the compensated feedback loop and contributes to the ANC gain of the ANC system. The other filter is a variable-response filter 42,42A that compensates for the variations of at least a portion of the response of secondary path S(z). The result is that the feedback ANC gain $G_{FB}(z)$ is rendered independent of the variations in the response of secondary path S(z). In the equation given above for feedback gain $G_{FB}(z)=1/(1+H(z)S(z))$ is equal to $1/(1+B(z)C(z)S(z))$. Thus when C(z) is set to the inverse $S^{-1}(z)$ of the response of secondary path S(z), $G_{FB}(z)=1/(1+B(z)S^{-1}(z)S(z))=1/(1+B(z)z^{-D})$ given $S^{-1}(z)\,S(z)=z^{-D}$, where $z^{-D}$ is a delay include to provide a causal design for filter 42A to model the inverse $S^{-1}(z)$ of the response of secondary path S(z). Thus, when $C(z)=S^{-1}(z)$, the variable transfer function of filter 42, 42A in the circuits of FIGS. 4A-4D compensates for variation in the response of secondary path S(z). The feedback gain $G_{FB}(z)$ therefore becomes a uniform feedback gain $G_{FB,uniform}(z)$ that no longer depends upon the variable response of secondary path S(z). Uniform feedback gain $G_{FB,uniform}(z)$ then relates to or depends upon only a fixed transfer function B(z) and a set delay $z^{-D}$ and fixed transfer function B(z) becomes the sole control variable in determining the ANC feedback control response. In each of the cascaded filter configurations shown in FIGS. 4A-4D, the order of filter 40 and filters 42, 42A in the cascade may be interchanged.

Figure 4A:
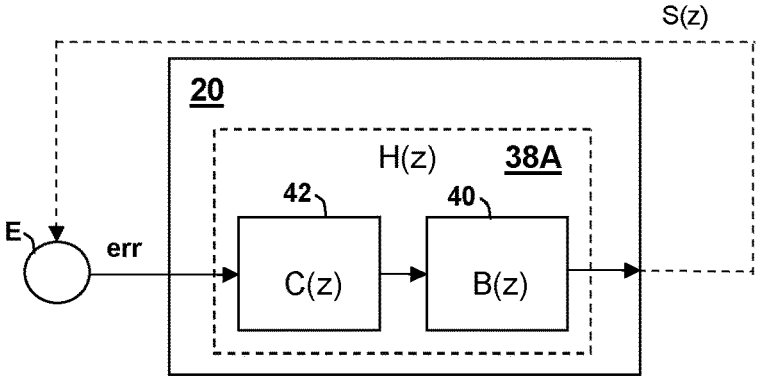
FIGS. 4A-4D are block diagrams depicting various examples of ANC circuits that can be used to implement ANC circuit 30 of audio integrated circuits 20A-20B of FIG. 2.
Figure 4B:
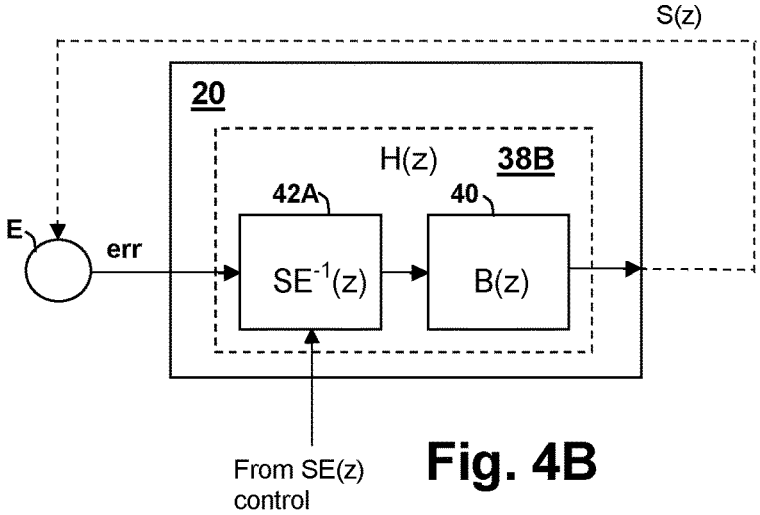
Figure 4C:
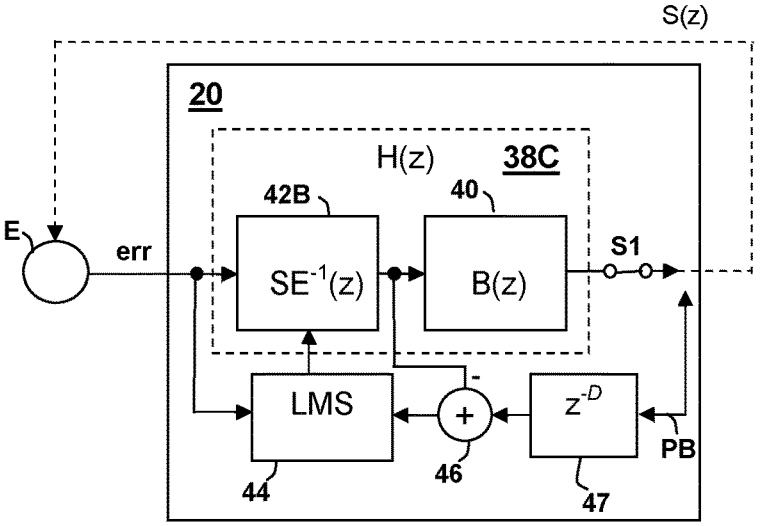

FIG. 4A shows an ANC feedback filter 38A that receives the error microphone signal err from error microphone E, filters the error microphone signal with filter 42 having a response C(z), and filters the output of filter 42 with another filter 40 having a predetermined fixed response B(z). Response C(z) represents any filter response that helps stabilize the ANC system against variations in the response of secondary path S(z), and depending on other portions of the system response, may or may not be exactly equal to the inverse $S^{-1}(z)$ of the response of secondary path S(z). FIG. 4B illustrates another ANC feedback filter 38B in which first filter 42A has a response $SE^{-1}(z)$ that is an estimate of the inverse $S^{-1}(z)$ of the response of secondary path S(z), and is controlled according to control signals from a secondary path estimator SE(z) control circuit. FIG. 4C illustrates yet another ANC feedback filter 38C in which first filter 42B is an adaptive filter that estimates response $S^{-1}(z)$ to generate inverse response $SE^{-1}(z)$ via off-line calibration. When a switch S1 is opened (and thus ANC operation is muted), a playback signal PB (that is also reproduced by the output transducer) with delay $z^{-D}$ applied by delay 47 is correlated with error microphone signal err by a least-means-squared (LMS) coefficient controller 44, after the output of first filter 42B is subtracted from playback signal PB by a combiner 46. The resulting adaptive filter obtains an estimate of the response of secondary path S(z) by directly measuring the effect of the response of secondary path S(z) on playback signal PB. When ANC circuit 38C is operated on-line, switch S1 is closed and the outputs of LMS coefficient controller 44 are held constant and converted to invert the response of adaptive filter 42A to yield response $SE^{-1}(z)$. Adaptive filter 42A operates as a fixed non-adaptive filter when on-line.

Figure 4D:
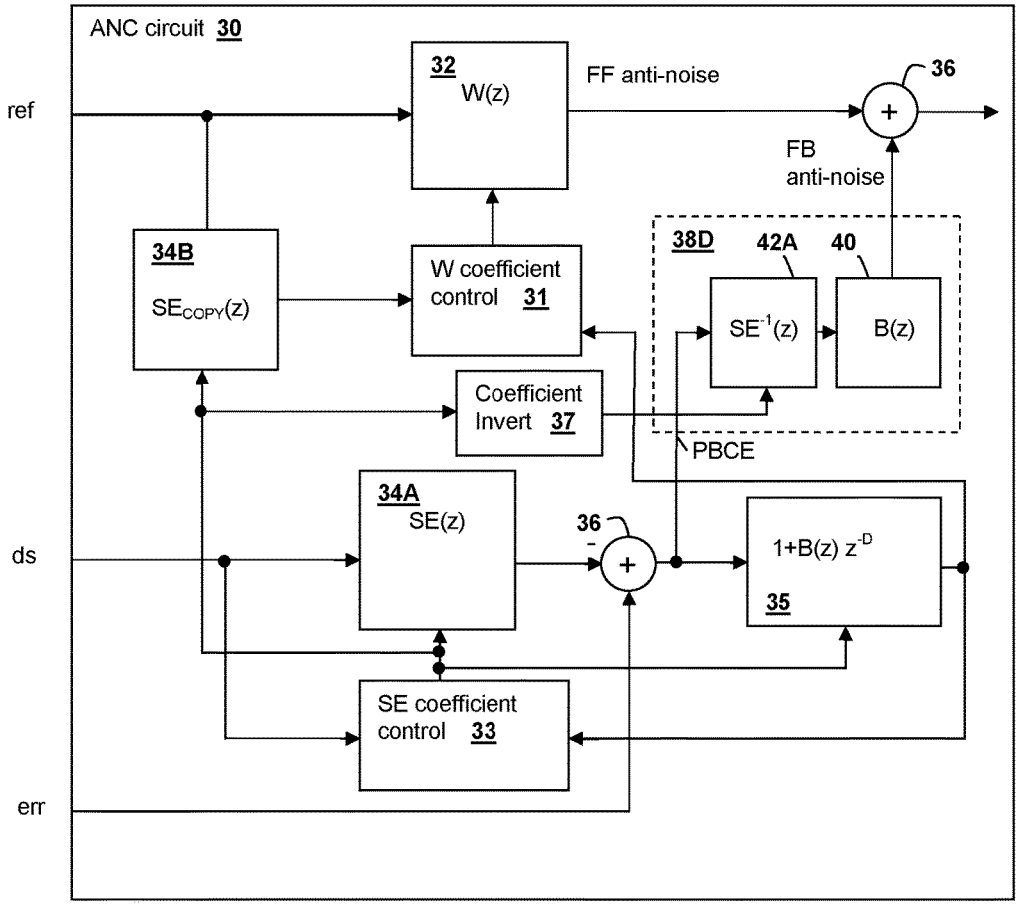

Referring to FIG. 4D, a feed-forward/feedback implementation of the above-described control scheme is shown. Adaptive feed-forward filter 32 receives reference microphone signal ref and under ideal circumstances, adapts its transfer function W(z) to be some portion of P(z)/S(z) to generate the feed-forward anti-noise signal FF anti-noise, which is provided to output combiner 36 that combines feed-forward anti-noise signal FF anti-noise with a feedback anti-noise signal FB anti-noise generated by an ANC feedback filter 38D. As described above, ANC feedback filter 38D includes first filter 40 having fixed predetermined response B(z) and variable-response filter 42A that receives control inputs that cause the response of filter 42A to model inverse response $SE^{-1}(z)$. The coefficients of feed-forward adaptive filter 32 are controlled by a W coefficient control block 31 that uses a correlation of two signals to determine the response of adaptive filter 32, which generally minimizes the error, in a least-mean squares sense, between those components of reference microphone signal ref present in error microphone signal err. The signals processed by W coefficient control block 31 are the reference microphone signal ref as shaped by a copy of an estimate of the response of path S(z) provided by a controllable filter 34B and another signal that includes error microphone signal err. By transforming reference microphone signal ref with a copy of the estimate SE(z) of the response of secondary path S(z), response $SE_{COPY}(z)$, and minimizing error microphone signal err after removing components of error microphone signal err due to playback of source audio, i.e., playback corrected error signal PBCE, adaptive filter 32 adapts to the desired portion of the response of P(z)/S(z). To generate the estimate SE(z) of the response of secondary path S(z), ANC circuit 30 includes controllable filter 34B having an SE coefficient control block 33 that provides control signals that set the response of adaptive filter 34A and controllable filter 34B to response SE(z). SE coefficient control block 33 also provides control signals to coefficient inversion block 37 that computes coefficients that set the response of variable response filter 42A to inverse response $SE^{-1}(z)$ from the coefficients that determine response SE(z).

In addition to error microphone signal err, the other signal processed along with the output of controllable filter 34B by W coefficient control block 31 includes an inverted amount of the source audio including downlink audio signal ds and internal audio ia that has been processed by filter response SE(z), of which response $SE_{COPY}(z)$ is a copy. By injecting an inverted amount of source audio, adaptive filter 32 is prevented from adapting to the relatively large amount of source audio present in error microphone signal err and by transforming the inverted copy of downlink audio signal ds and internal audio ia with the estimate of the response of path S(z). The source audio that is removed from error microphone signal err before processing should match the expected version of downlink audio signal ds, and internal audio ia reproduced at error microphone signal err, since the electrical and acoustical path of S(z) is the path taken by downlink audio signal ds and internal audio ia to arrive at error microphone E. Filter 34B is not an adaptive filter, per se, but has an adjustable response that is tuned to match the response of adaptive filter 34A, so that the response of controllable filter 34B tracks the adapting of adaptive filter 34A.

Adaptive filter 34A and SE coefficient control block 33 process the source audio (ds+ia) and error microphone signal err after removal, by combiner 36, of the above-described filtered downlink audio signal ds and internal audio ia, that has been filtered by adaptive filter 34A to represent the expected source audio delivered to error microphone E. The output of combiner 36 is further filtered by an alignment filter 35 having response $1+B(z)z^{-D}$ to remove the effects of the feedback signal path on the source audio delivered to error microphone E. Alignment filter 35 is described in further detail in U.S. patent application Ser. No. 14/832,585 filed on Aug. 21, 2015 entitled "HYBRID ADAPTIVE NOISE CANCELLATION SYSTEM WITH FILTERED ERROR MICROPHONE SIGNAL", the disclosure of which is incorporated herein by reference. In the above-incorporated patent application, an alignment filter is used having variable response 1+SE(z)H(z) to remove the effect of the feedback portion of the ANC system, including the secondary path, on the error signal, but since in the instant disclosure $H(z)=B(z)SE^{-1}(z)$, alignment filter 35 has response $1+SE(z)H(z)=1+SE(z)SE^{-1}(z)B(z)=1+B(z)z^{-D}$. Adaptive filter 34A is thereby adapted to generate a signal from downlink audio signal ds and internal audio ia, that when subtracted from error microphone signal err, contains the content of error microphone signal err that is not due to source audio (ds+ia).

Figure 5A:
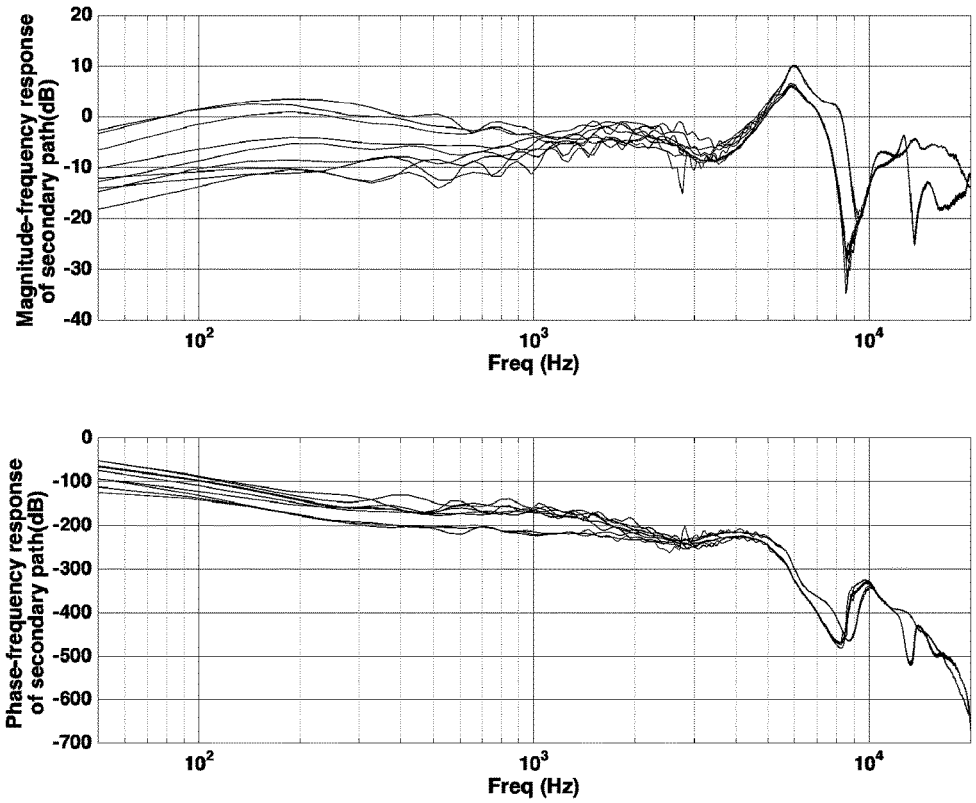
FIGS. 5A-5F are graphs depicting acoustic and electric responses within the ANC systems disclosed herein.
Figure 5B:
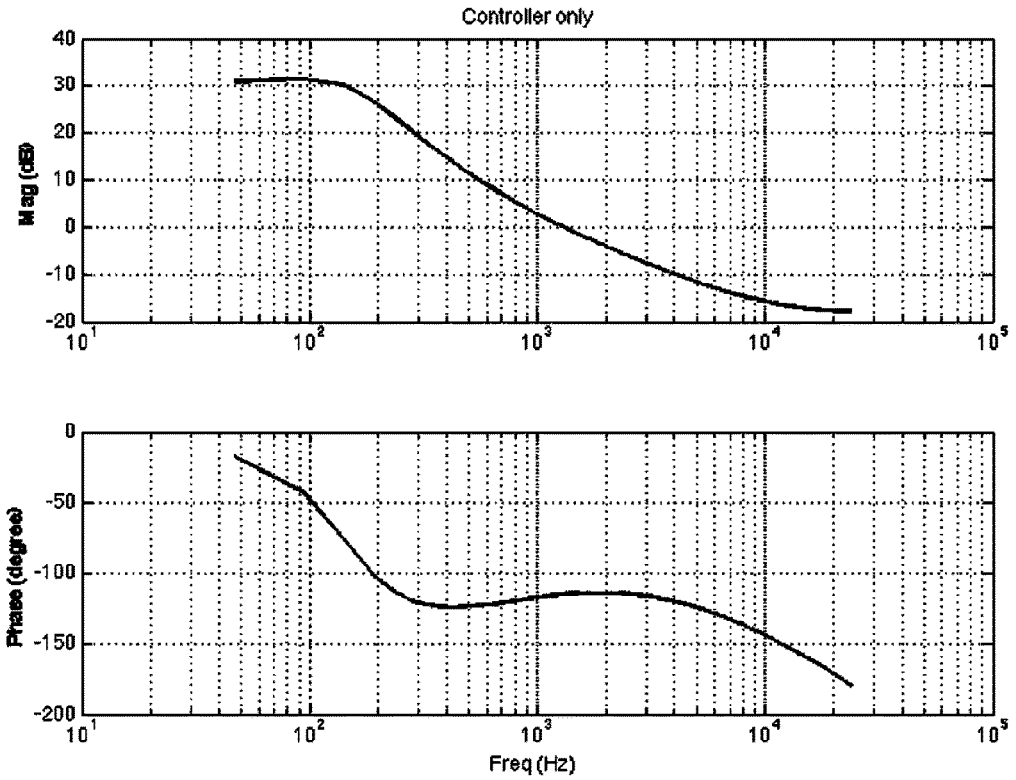
Figure 5C:
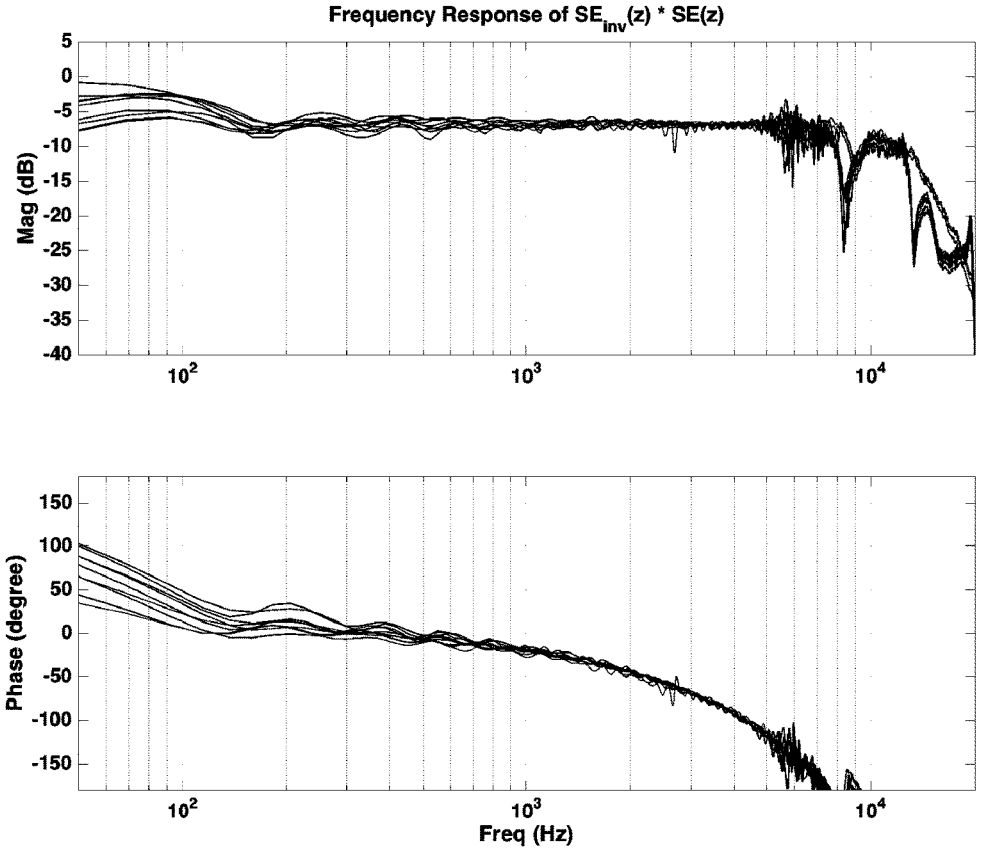
Figure 5D:
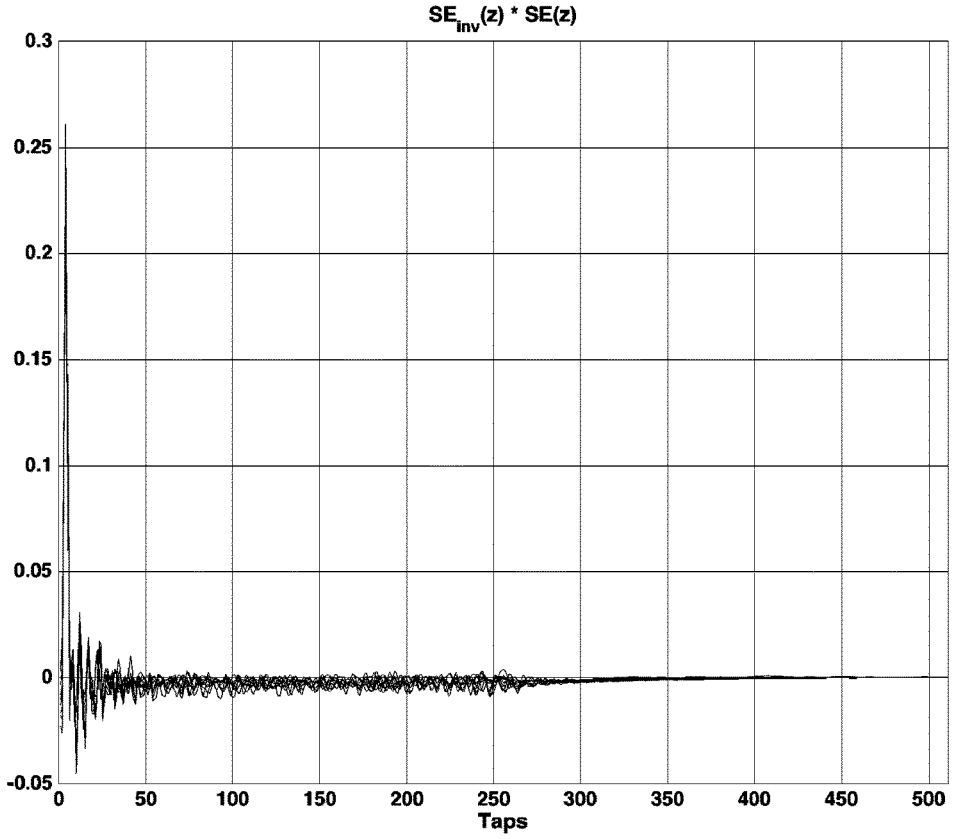
Figure 5E:
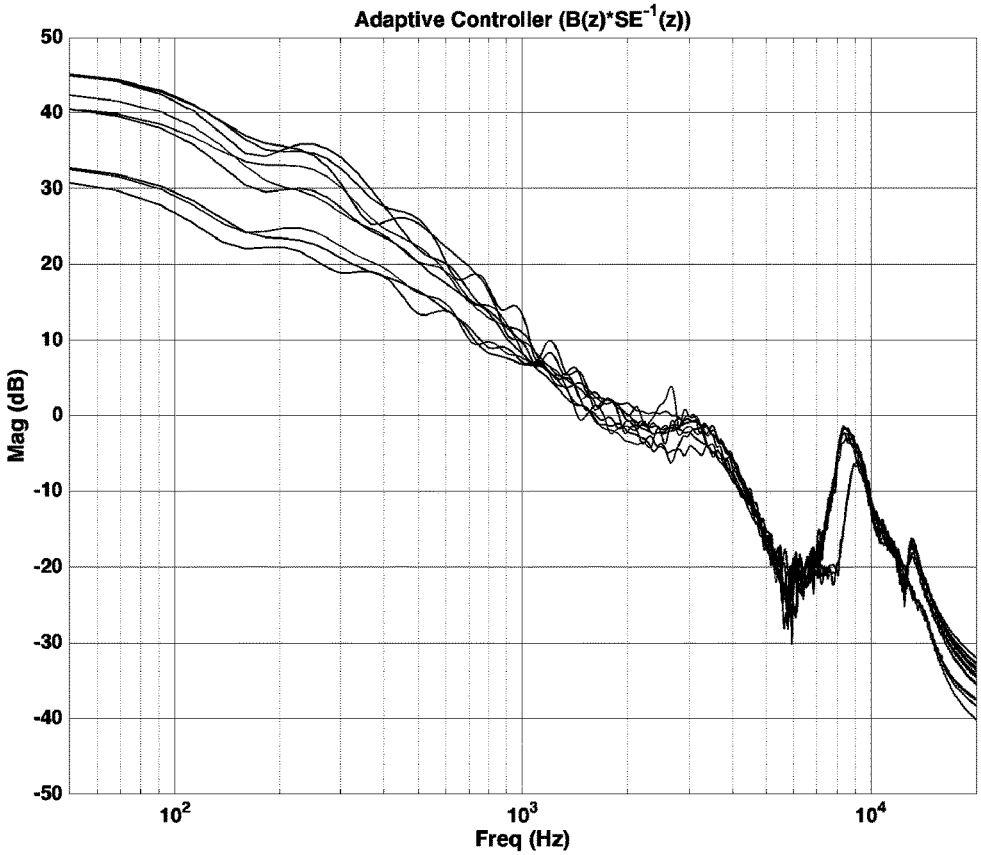
Figure 5F:
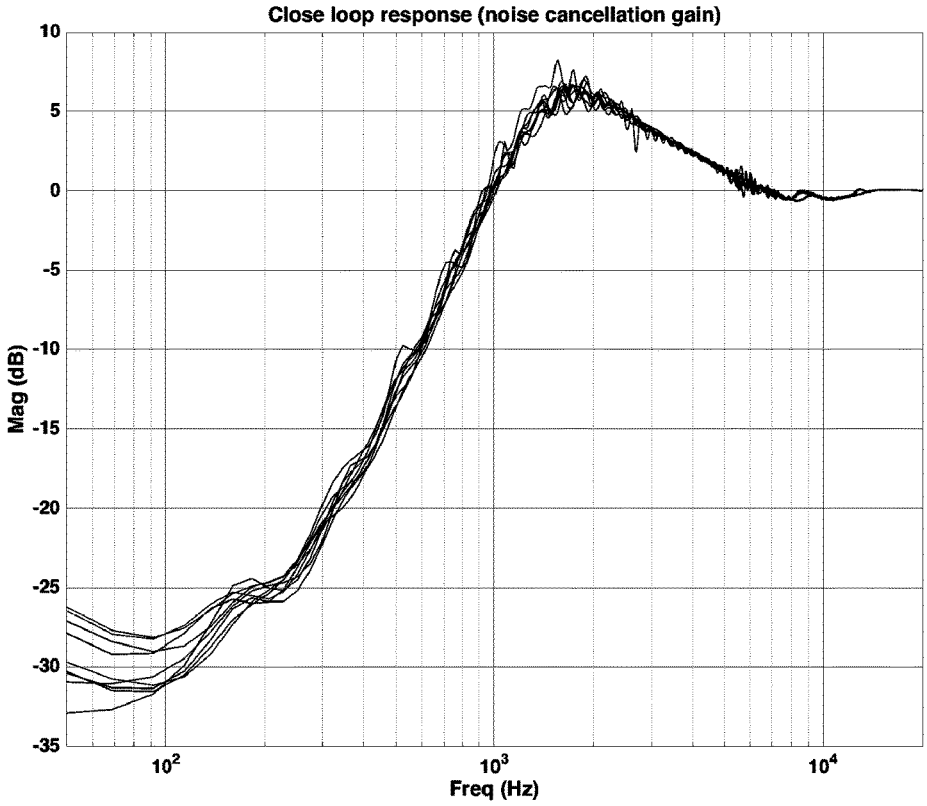

Referring now to FIGS. 5A-5F, graphs of amplitude and phase responses of portions of the ANC systems described above are shown. FIG. 5A shows an amplitude response (top) and phase response (bottom) of secondary path S(z) for various users. As can be seen from the graph, the variation in the amplitude of the response of secondary path S(z) varies by 10 dB or more in frequency regions of interest (typically 200 Hz to 3 KHz). FIG. 5B shows a possible design amplitude response (top) and phase response (bottom) of filter 40 response B(z), while FIG. 5C shows the response of $SE(z)SE^{-1}(z)$ for a simulated ANC system in accordance with the above disclosure. FIG. 5D shows a convolution of $SE(z)SE^{-1}(z)$, illustrating that the resulting response is a short delay, e.g., 3 taps of filter 42, 42A. FIG. 5E shows the response B(z)C(z) of the adaptive controller in the simulated system, and FIG. 5F shows the closed-loop response of the simulated system, showing that the gain variation for all users has been reduced to about 2 dB across the entire illustrated frequency range.

Figure 6:
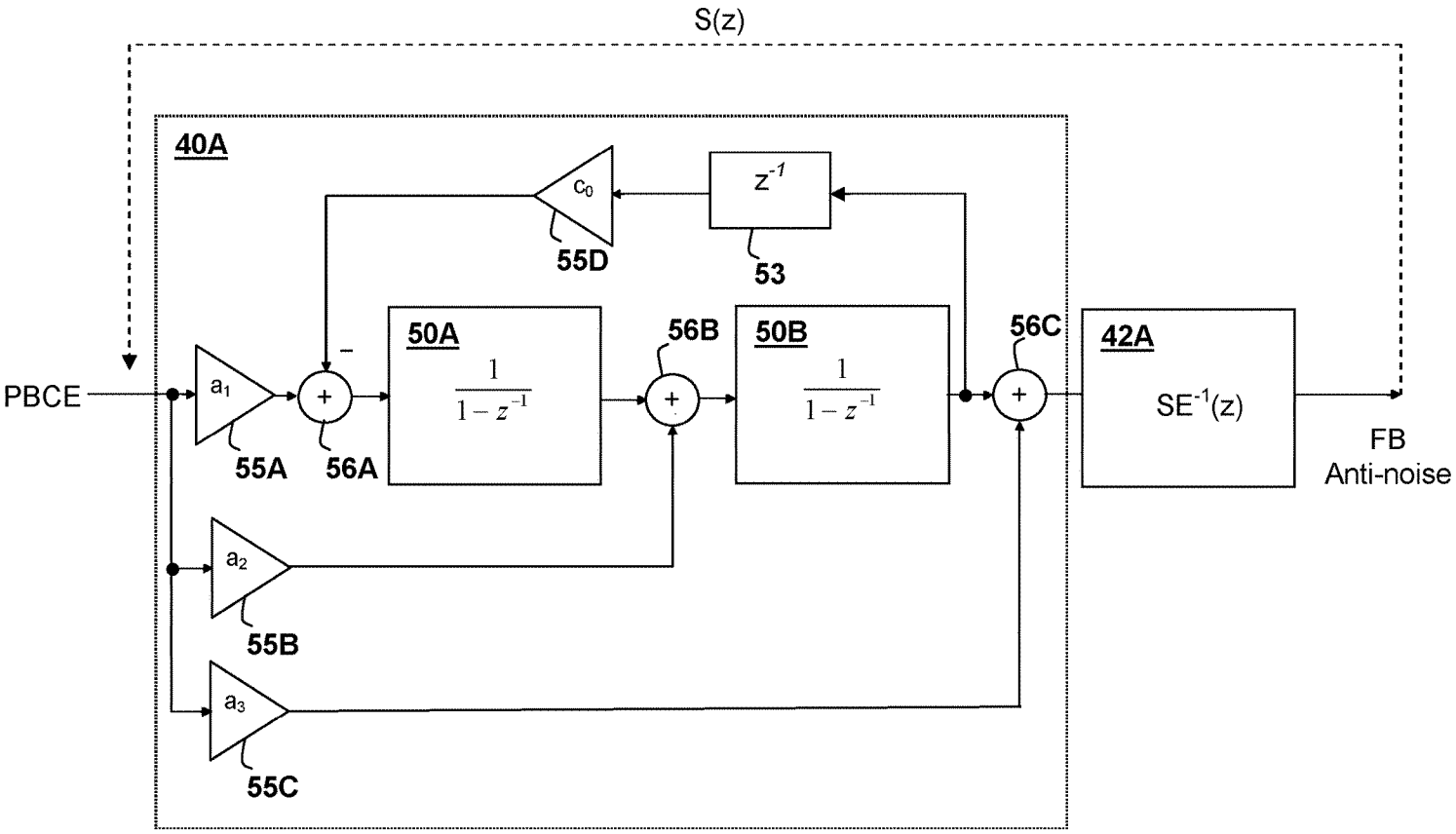
FIG. 6 is a block diagram depicting a digital filter that can be used to implement fixed response filter 40 within the circuits depicted in FIGS. 4A-4D.

Referring now to FIG. 6, a filter circuit 40A that may be used to implement fixed filter 40 is shown. The input signal is weighted by coefficients $a_1$, $a_2$ and $a_3$ by corresponding multipliers 55A, 55B and 55C and provided to respective combiners 56A, 56B, 56C at feed-forward taps of the filter stages, which comprise digital integrators 50A and 50B. A feedback tap is provided by a delay 53 and a multiplier 55D, providing the second-order low-pass response illustrated in FIG. 5A. The resulting topology is a delta-sigma type filter. Depending on requirements of the ANC system, the response of fixed filter 40 may be a low-pass response, or a band-pass response.

Figure 7:
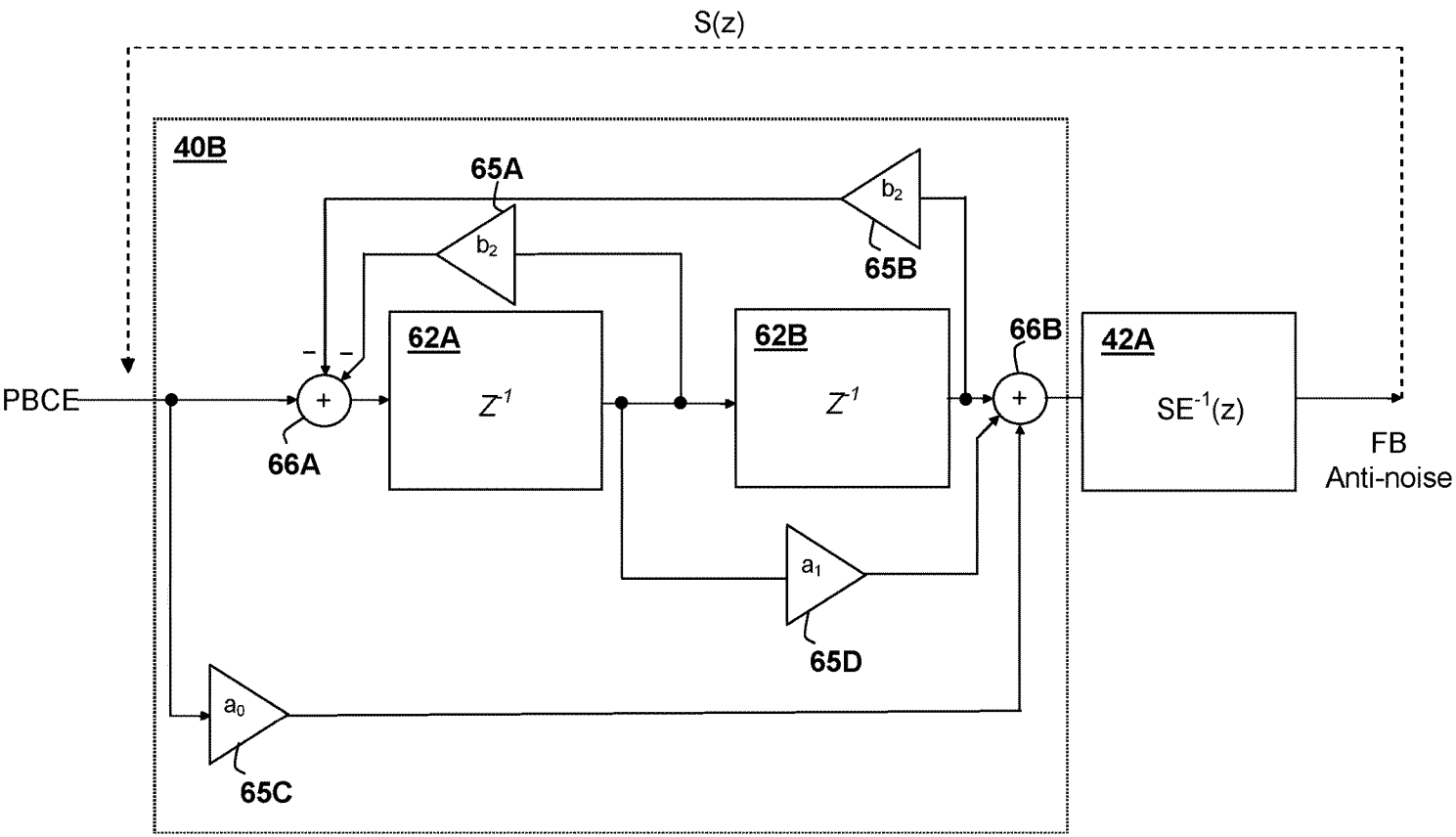
FIG. 7 is a block diagram depicting an alternative digital filter that can be used to implement fixed response filter 40 within the circuits depicted in FIGS. 4A-4D.

Referring now to FIG. 7, an alternative filter circuit 40B that may be used to implement fixed filter 40 is shown. The input signal is weighted by coefficient $a_0$ by multiplier 65C and added to the output signal by combiner 66B to provide a feed-forward tap and the output of a first delay 62A is weighted by coefficient $a_0$ by another multiplier 65D and also combined with the output signal by combiner 66B. A second delay 62B provides a third input to combiner 66B. The input signal is combined with feedback signals provided from the output of first delay 62A and weighted by coefficient $b_1$ by a multiplier 65A and from the output of second delay 62B and weighted by coefficient $b_2$ by a multiplier 65B. The resulting filter is a bi-quad that can be used to implement a low-pass or band-pass filter as described above.

Figure 8:
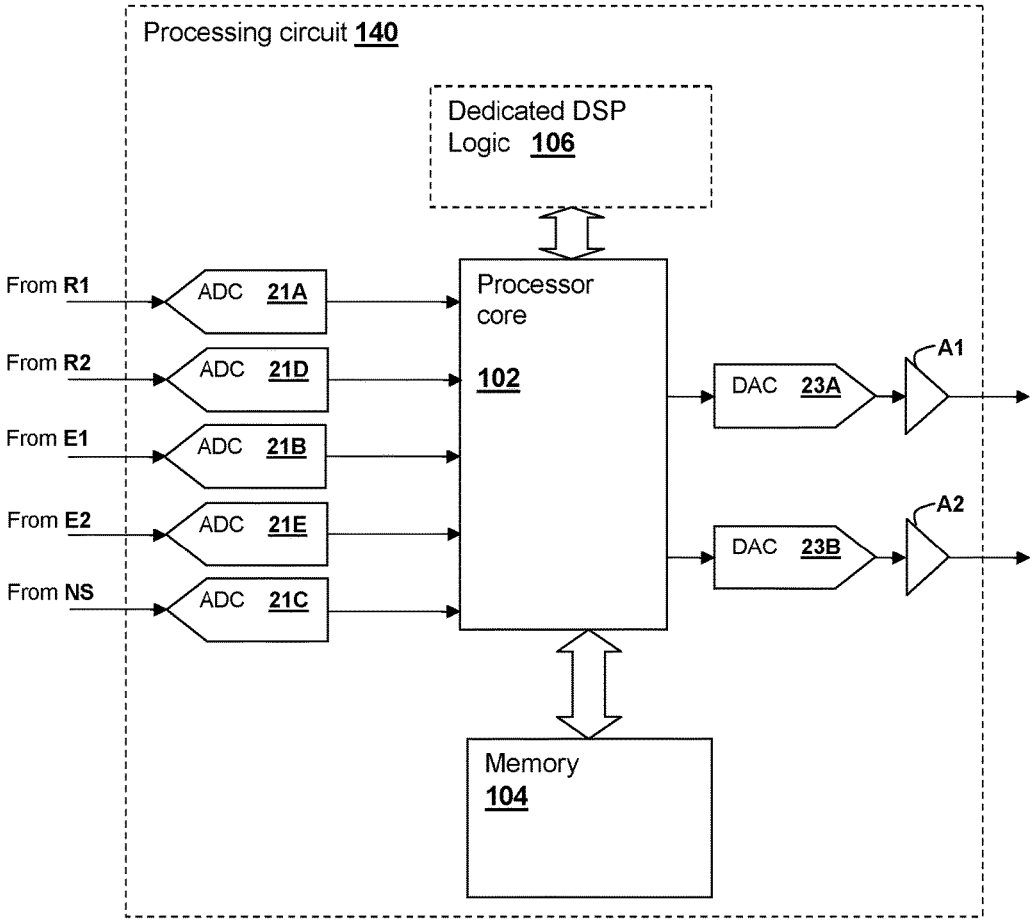
FIG. 8 is a block diagram depicting signal processing circuits and functional blocks that can be used to implement the circuits depicted in FIG. 2 and FIGS. 4A-4D.

Referring now to FIG. 8, a block diagram of an ANC system is shown for implementing ANC techniques as described above and having a processing circuit 140 as may be implemented within audio integrated circuits 20A, 20B of FIG. 2, which is illustrated as combined within one circuit, but could be implemented as two or more processing circuits that inter-communicate. A processing circuit 140 includes a processor core 102 coupled to a memory 104 in which are stored program instructions comprising a computer program product that may implement some or all of the above-described ANC techniques, as well as other signal processing. Optionally, a dedicated digital signal processing (DSP) logic 106 may be provided to implement a portion of, or alternatively all of, the ANC signal processing provided by processing circuit 140. Processing circuit 140 also includes ADCs 21A-21E, for receiving inputs from reference microphone R1 (or error microphone R), error microphone E1 (or error microphone E), near speech microphone NS, reference microphone R2, and error microphone E2, respectively. In alternative embodiments in which one or more of reference microphone R1, error microphone E1, near speech microphone NS, reference microphone R2, and error microphone E2 have digital outputs or are communicated as digital signals from remote ADCs, the corresponding ones of ADCs 21A-21E are omitted and the digital microphone signal(s) are interfaced directly to processing circuit 140. A DAC 23A and amplifier A1 are also provided by processing circuit 140 for providing the speaker output signal to speaker SPKR1, including anti-noise as described above. Similarly, a DAC 23B and amplifier A2 provide another speaker output signal to speaker SPKR2. The speaker output signals may be digital output signals for provision to modules that reproduce the digital output signals acoustically.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. An adaptive noise cancellation (ANC) controller, comprising:

a fixed filter having a predetermined fixed transfer function (B(z)) that relates to and maintains stability of a compensated feedback loop, wherein the fixed filter contributes to an ANC gain of an ANC system; and a variable-response filter coupled to the fixed filter, wherein a response of the variable-response filter compensates for variations of a transfer function of a secondary path that includes at least a path from a transducer of the ANC system to a sensor of the ANC system, so that the ANC gain is independent of the variations in the transfer function of the secondary path, wherein the response of the variable-response filter is an inverse of the transfer function of the secondary path.

2. The ANC controller of claim 1, wherein the fixed filter causes the ANC gain to be a uniform feedback gain that depends on the predetermined fixed transfer function.

3. The ANC controller of claim 1, wherein the response of the variable response filter is controlled in conformity with a control output of an adaptive filter of the ANC system.

4. The ANC controller according to claim 3, wherein the variable-response filter is the adaptive filter, whereby the response of the variable-response filter is dependent on frequency content of a signal provided as an input to the variable response filter to which the response of the variable-response filter is applied.

5. The ANC controller according to claim 3, wherein the adaptive filter is an adaptive filter of a feed-forward portion of the ANC system that adapts to cancel the effects of the secondary path on a component of a signal reproduced by the transducer of the ANC system.

6. The ANC controller according to claim 1, wherein the sensor is a microphone and the transducer is a speaker.

7. An integrated circuit (IC) for implementing at least a portion of an audio device including acoustic noise canceling, the integrated circuit comprising:

an output for providing an output signal to an output transducer including an anti-noise signal for countering the effects of ambient audio sounds in an acoustic output of the transducer;

at least one microphone input for receiving at least one microphone signal indicative of the ambient audio sounds and that contains a component due to the acoustic output of the transducer; and a processing circuit that adaptively generates the anti-noise signal to reduce the presence of the ambient audio sounds heard by the listener, wherein the processing circuit implements a feedback filter having a response that generates at least a portion of the anti-noise signal from the at least one microphone signal, the feedback filter comprising a fixed filter having a predetermined fixed transfer function (B(z)) and a variable-response filter coupled to the fixed filter, wherein a response of the variable-response filter compensates for variations of a transfer function of a secondary path that includes at least a path from the transducer to the at least one microphone, wherein the response of the variable-response filter is an inverse of the transfer function of the secondary path.

8. The integrated circuit of claim 7, wherein the fixed filter causes an ANC gain of the system formed by the feedback filter, the transducer, the at least one microphone and the secondary path to be a uniform feedback gain that depends on the predetermined fixed transfer function.

9. The integrated circuit of claim 7, wherein the response of the variable response filter is controlled in conformity with a control output of an adaptive filter implemented by the processing circuit that models the secondary path.

10. The integrated circuit of claim 9, wherein the variable-response filter is the adaptive filter, whereby the response of the variable-response filter is dependent on frequency content of a signal provided as an input to the variable response filter to which the response of the variable-response filter is applied.

11. The integrated circuit of claim 9, wherein the processing circuit further implements a feed-forward adaptive filter that generates another portion of the anti-noise signal, and further implements a secondary path adaptive filter that adapts to cancel the effects of the secondary path on a component of a source audio signal reproduced by the transducer of the ANC system.

12. A method of canceling effects of ambient noise, the method comprising:

adaptively generating an anti-noise signal to reduce the presence of the ambient noise;

providing the anti-noise signal to a transducer;

measuring the ambient noise with a sensor of an ANC system; and filtering an output of the sensor with a fixed filter having a predetermined fixed transfer function (B(z)) that relates to and maintains stability of a compensated feedback loop, wherein the fixed filter contributes to an ANC gain of the ANC system and a variable-response filter coupled to the fixed filter, wherein a response of the variable-response filter compensates for variations of a transfer function of a secondary path that includes at least a path from a transducer of the ANC system to the sensor, so that the ANC gain is independent of the variations in the transfer function of the secondary path, wherein the response of the variable-response filter is an inverse of the transfer function of the secondary path.

13. The method of claim 12, wherein the filtering causes the ANC gain to be a uniform feedback gain that depends on the predetermined fixed transfer function.

14. The method of claim 12, further comprising controlling the response of the variable response filter in conformity with a control output of an adaptive filter of the ANC system.

15. The method of claim 14, wherein the variable-response filter is the adaptive filter, wherein the response of the variable-response filter controlled in dependence on frequency content of a signal provided as an input to the variable response filter to which the response of the variable-response filter is applied.

16. The method of claim 14, wherein the adaptive filter is an adaptive filter of a feed-forward portion of the ANC system that adapts to cancel the effects of the secondary path on a component of a signal reproduced by the transducer of the ANC system.

17. The method of claim 12, wherein the sensor is a microphone and the transducer is a speaker.

* * * * *